US006336022B2

(12) United States Patent
Ichikawa et al.

(10) Patent No.: US 6,336,022 B2
(45) Date of Patent: Jan. 1, 2002

(54) DEVELOPING UNIT

(75) Inventors: Kazuhiro Ichikawa; Yoshihiro Nakashima; Hidenori Kin; Tomoe Aruga; Yoichi Yamada; Yukio Takayama; Tahei Ishiwatari, all of Nagano (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 09/754,340

(22) Filed: Jan. 5, 2001

Related U.S. Application Data

(62) Division of application No. 09/369,936, filed on Aug. 9, 1999, which is a division of application No. 09/015,917, filed on Jan. 30, 1998, now abandoned.

(30) Foreign Application Priority Data

| | | |
|---|---|---|
| Jan. 31, 1997 | (JP) | 9-32678 |
| Feb. 28, 1997 | (JP) | 9-46458 |
| Feb. 28, 1997 | (JP) | 9-46459 |
| Feb. 28, 1997 | (JP) | 9-46460 |
| Feb. 28, 1997 | (JP) | 9-46467 |
| Feb. 28, 1997 | (JP) | 9-46468 |
| Feb. 28, 1997 | (JP) | 9-46469 |
| Feb. 28, 1997 | (JP) | 9-46470 |
| Feb. 28, 1997 | (JP) | 9-46471 |
| Feb. 28, 1997 | (JP) | 9-46472 |
| Feb. 28, 1997 | (JP) | 9-46473 |

(51) Int. Cl.[7] ..... G03G 15/08
(52) U.S. Cl. ..... 399/254; 399/281
(58) Field of Search ..... 399/279, 281, 399/254, 256

(56) References Cited

U.S. PATENT DOCUMENTS

| | | | | |
|---|---|---|---|---|
| 3,999,514 | A | 12/1976 | Abbott et al. | 399/256 |
| 4,227,797 | A | 10/1980 | Tsunoi | |
| 4,592,653 | A | 6/1986 | Ikeda et al. | 399/103 |

(List continued on next page.)

FOREIGN PATENT DOCUMENTS

| | | |
|---|---|---|
| JP | 63-208877 | 8/1988 |
| JP | 63-244054 | 10/1988 |
| JP | 1-277868 | 11/1989 |
| JP | 2-037378 | 2/1990 |
| JP | 2-054289 | 2/1990 |
| JP | 3-235974 | 10/1991 |
| JP | 4-355461 | 12/1992 |
| JP | 5-134527 | 5/1993 |
| JP | 5-142938 | 6/1993 |
| JP | 5-341636 | 12/1993 |
| JP | 6-167887 | 6/1994 |
| JP | 7-013390 | 1/1995 |
| JP | 7-271178 | 10/1995 |
| JP | 7-301990 | 11/1995 |
| JP | 8-062958 | 3/1996 |
| JP | 8-106216 | 4/1996 |
| JP | 8-146625 | 6/1996 |
| JP | 8-328374 | 12/1996 |

*Primary Examiner*—Robert Beatty
(74) *Attorney, Agent, or Firm*—Sughrue Mion, PLLC

(57) ABSTRACT

A developing unit of the present invention includes a case which accommodates toner containing pigment, a developing roller, a supply roller formed of an elastic member arranged to be pressed against a surface of the developing roller in such a manner as to supply toner to the surface of the developing roller. The toner is mixed by conveying fins which have phases that are different in such a manner that the loads are uniform in rotation

1 Claim, 10 Drawing Sheets

U.S. PATENT DOCUMENTS 4,788,570 A 11/1988 Ogata et al. ..... 399/283
4,866,480 A 9/1989 Hosoya et al. ..... 399/281
4,930,438 A 6/1990 Demizu et al. ..... 399/281
4,987,452 A 1/1991 Nakagawa et al. ..... 399/254
5,086,728 A 2/1992 Kinoshita
5,134,960 A 8/1992 Shirai ..... 399/105
5,151,739 A 9/1992 Hediger ..... 399/256
5,172,168 A 12/1992 Satoh et al. ..... 399/224
5,270,786 A 12/1993 Kikuchi et al. ..... 399/286
5,286,917 A 2/1994 Unno et al. ..... 399/279
5,287,150 A 2/1994 Kinoshita et al. ..... 399/281
5,294,968 A 3/1994 Ueda et al. ..... 399/256
5,311,264 A 5/1994 Kinoshita ..... 399/281
5,365,318 A 11/1994 Hiraoka et al. ..... 399/44
5,563,693 A 10/1996 Takahata et al. ..... 399/310
5,585,895 A 12/1996 Yashiro et al. ..... 399/103
5,592,268 A 1/1997 Uehara et al. ..... 399/276
5,617,191 A 4/1997 Murakami et al.
5,625,440 A 4/1997 Matsumae et al.
5,655,197 A 8/1997 Okada et al. ..... 399/281
5,659,859 A 8/1997 Kikuta et al. ..... 399/256
5,697,026 A 12/1997 Matsumae et al.
5,701,558 A 12/1997 Kojima ..... 399/103
5,729,811 A 3/1998 Takahata et al. ..... 399/316
5,752,145 A 5/1998 Nakaue et al. ..... 399/256
5,758,230 A 5/1998 Kanaue et al. ..... 399/103
5,797,070 A 8/1998 Waki et al. ..... 399/149
5,854,960 A 12/1998 Tagansky et al.

FIG. 9(a)

MEASURED DISTRIBUTION OF PARTICLE SIZE

| | VOLUME | | NUMBER | |
|---|---|---|---|---|
| RESULTS OF CALCULATION | 25.4 μ ↑ : 0<br>6.35 μ ↓ : 22.07<br>25.4 μ ↑ : 0<br>32.0 μ ↓ : 100<br>KURTOSIS : .8295<br>SKEWNESS : -.5318 | MEAN : 7.750<br>25% : 6.466<br>50% : 7.556<br>75% : 8.937<br>CV% : 23.09<br>SD μ : 1.789 | 25.4 μ ↑ : .001<br>6.35 μ ↓ : 49.84<br>25.4 μ ↑ : 0<br>32.0 μ ↓ : 100<br>KURTOSIS : .3395<br>SKEWNESS : -.0423 | MEAN : 6.454<br>25% : 5.18<br>50% : 6.357<br>75% : 7.596<br>CV% : 28.17<br>SD μ : 1.818 |

| | CH | RANGE μm | DIE % | CUM % | DIF N | COM N | DIF % | CUM % |
|---|---|---|---|---|---|---|---|---|
| RESULTS OF MEASUREMENT | 1 | 1.26~1.59 | 0.0 | 0.0 | 0 | 0 | 0.0 | 0.0 |
| | 2 | 1.59~2.00 | 0.0 | 0.0 | 0 | 0 | 0.0 | 0.0 |
| | 3 | 2.00~2.52 | 0.0 | 0.0 | 865 | 865 | 1.7 | 1.7 |
| | 4 | 2.52~3.17 | 0.0 | 0.0 | 991 | 1856 | 2.0 | 3.7 |
| | 5 | 3.17~4.00 | 0.5 | 0.5 | 1884 | 3740 | 3.8 | 7.5 |
| | 6 | 4.00~5.04 | 4.5 | 5.0 | 7088 | 10828 | 14.2 | 21.7 |
| | 7 | 5.04~6.35 | 17.1 | 22.1 | 14094 | 24922 | 28.2 | 49.8 |
| | 8 | 6.35~8.00 | 37.1 | 59.1 | 16205 | 41127 | 32.4 | 82.3 |
| | 9 | 8.00~10.1 | 33.4 | 92.5 | 7958 | 49085 | 15.9 | 98.2 |
| | 10 | 10.1~12.7 | 6.7 | 99.2 | 860 | 49945 | 1.7 | 99.9 |
| | 11 | 12.7~16.0 | 0.8 | 100.0 | 52 | 49997 | 0.1 | 100.0 |
| | 12 | 16.0~20.2 | 0.0 | 100.0 | 2 | 49999 | 0.0 | 100.0 |
| | 13 | 20.2~25.4 | 0.0 | 100.0 | 0 | 49999 | 0.0 | 100.0 |
| | 14 | 25.4~32.0 | 0.0 | 100.0 | 1 | 50000 | 0.0 | 100.0 |
| | 15 | 32.0~40.3 | 0.0 | 100.0 | 0 | 50000 | 0.0 | 100.0 |
| | 16 | 40.3~50.8 | 0.0 | 100.0 | 0 | 50000 | 0.0 | 100.0 |

DEVELOPING UNIT

This is a divisional of Application Ser. No. 09/369,936 filed Aug. 9, 1999, which is a divisional application of Ser. No. 09/015,917, filed Jan. 30, 1998 now abandoned, the disclosures of which are incorporated herein by reference.

BACKGROUND OF THE INVENTION

The present invention relates to a developing unit for use in an image forming apparatus, such as a printer, a facsimile machine or a copying machine, which forms an image by using an electrophotography technique.

In general, an image forming apparatus using an electrophotography technique includes a photosensitive member having a photosensitive layer on the outer surface thereof, a charging device for uniformly electrically charging the outer surface of the photosensitive member, an exposing device for selectively exposing the outer surface, which has been uniformly electrostatically charged by the charging device, so as to form an electrostatic latent image, a developing device for supplying toner serving as a developer to the electrostatic latent image formed by the exposing device so as to form a visible image (a toner image) and a transfer device for transferring the toner image formed by the developing device to a transfer medium, such as paper.

A conventional developing unit includes a case for accommodating toner; a developing roller rotatably supported by the case by dint of a shaft; a supply roller rotatably supported by the case by dint of a shaft and formed of an elastic member arranged to be pressed against the surface of the developing roller so as to supply toner to the surface of the developing roller; and a conveying fin rotatably supported by the case by dint of a shaft in such a manner as to convey toner to the surface of the supply roller, wherein the elements are sequentially disposed in a horizontal direction.

A conventional developing unit also includes a restraining blade for restraining a quantity of toner on the developing roller, as well as a sealing member disposed on the sides of the developing roller and the supply roller so as to prevent leakage of toner through their shaft portions to the outside of the case.

The conventional developing unit uses a known contact development method in which the developing roller and the photosensitive member are disposed adjacently or in contact with each other. In the contact method, an edge of the end portion of the surface of the developing roller for conveying toner comes in direct contact with the photosensitive member, which can undesirably damage the photosensitive member. If the developing roller is made of a solid material, such as metal, even a non-contact development method encounters damage of the photosensitive member attributable to sliding and friction depending upon the accuracy in the deflection of the developing roller and that of the photosensitive member, as well as the contact development method.

Further, the conventional developing unit, has an elastic conveying member made of an expanded material or the like. Therefore, toner is continuously conveyed from the conveying member to the supply roller portion. As a result, the quantity of toner which is conveyed is larger than the quantity of toner which has been consumed by the developing roller in forming images. Thus, toner is compressed in the supply roller portion and the developing roller portion. If such compression is continued, the pressure in the case at the positions near the developing roller is excessively raised by the restraining blade to appropriately restrain toner on the developing roller. The excessive conveyance of toner from the restraining blade changes the density of a formed image and causes toner to be leaked. If color toner having unsatisfactory fluidity as compared with that of black toner is used, the above-mentioned compression becomes more critical because color toner having poor fluidity is continuously conveyed in the developing unit, and excess toner cannot be returned from the supply roller.

If the conventional developing unit performs a development process with dense toner having poor fluidity, the conveying fin generates a great rotational load which undesirably changes the necessary torque thereby causing rotation of the motor which drives the conveying fin. As a result, jitters appear in the formed image.

Moreover, the conventional developing unit suffers the problem that filming of the electrified members (such as the developing roller and the restraining blade), easily occurs because of mechanical contact and friction when the development process is performed using dense toner containing a large quantity of pigment. If filming of, for example, the pigment having the same polarity as that of toner, occurs with the electrified member, the electrification characteristic of toner deteriorates and becomes instable. When the electrification characteristic of the toner is instable, the density of the formed image is lowered and the toner supply characteristic deteriorates.

The conventional developing unit also has the toner seal disposed on the outer surface ends of the developing roller, thus toner in the sealing portion of the developing roller is not covered. Therefore, in the known contact development method, the photosensitive member is damaged because the sealing portion directly slides on the photosensitive member. When the developing roller is made of a solid material, such as metal, even a non-contact development method encounters damage of the photosensitive member attributable to sliding and abrasion depending upon the accuracy in the deflection of the developing roller and that of the photosensitive member, as well as the contact development method.

One problem encountered by the conventional developing unit is that the portion of the elastic supply roller pressed against the developing roller is dented, causing end portions of the supply roller to project sideways. The projecting portions then undesirably engage the sealing member, thereby requiring an excessively large drive torque in order to rotate the supply roller.

Another problem with the foregoing conventional developing unit arises from the hardening of the supply roller. The supply roller of the foregoing conventional developing unit is comprised of an elastic member, which is usually an expanded material having cells formed in the surface thereof. The portion of the supply roller which contacts with the developing roller encounters introduction of toner into the expanded material through the cells formed in the surface of the expanded material. As a result, the hardness of the expanded material is increased excessively after being used for a long time. The problem associated with the increase in hardness of the supply roller is that great torque is required to rotate the supply roller. To solve this problem, a supply roller comprising a closed-cell expanded material has been suggested. However, in recent years, the average particle size of toner has been reduced to 9 $\mu$m, and toner having such small particle size easily clogs in the cells formed in the surface of the conventional supply roller. The elastic characteristic of the supply roller thus deteriorates in a relatively short time.

Another problem in the foregoing conventional developing unit is that, if the rotational speed of the developing roller is increased to quickly form images, or if the fluidity of toner is increased to maintain the required toner supply characteristic, then toner is introduced into the end surface (the side surface) of the developing roller when the developing roller is rotated. As a result, toner leaks from the end surface of the developing roller into the image forming portion thus causing the inside portion of the image forming apparatus to be contaminated. Another problem associated with increased rotational speed of the developing roller and increased fluidity of toner is the leakage of toner from the lower surface of the developing roller during rotation of the developing roller. This also contaminates the inside portion of the image forming apparatus. When the image forming apparatus is contaminated in either above manner, it produces a defective image.

Another problem in the above-mentioned conventional developing unit is that an edge of the end portion of the surface of the developing roller comes in direct contact with the photosensitive member thereby causing damage to the photosensitive member.

The photosensitive member is also damaged by direct sliding contact with the sealing portion of the developing roller when a contact development method is used. In a contact development method, the developing roller and the photosensitive member are disposed adjacently or are brought into contact with each other. The toner seal for the developing roller of the conventional developing unit is disposed at the outer surface of the ends of the developing roller which leaves toner in the sealing portion of the developing roller not covered and which allows the seal to contact the photosensitive member.

In either case, if the developing roller is made of a solid material, such as metal, even a non-contact development method causes damage to the photosensitive member attributable to sliding and friction depending upon the accuracy in the deflection of the developing roller and that of the photosensitive member.

Another problem in the above-mentioned conventional developing unit arises in the conveyance of toner. Toner in the case is sequentially conveyed by the conveying member to the supply roller portion, and then from the supply roller to the developing roller portion. In a developing unit having an elastic conveying member made of an expanded material or the like, conveyance of toner from the conveying member to the supply roller portion is continuous. As a result, the quantity of toner which is continuously conveyed is larger than the quantity of toner which has been consumed for forming images by the developing roller. The excess toner in the vicinities of the supply roller portion and the developing roller portion causes a state of compression. If the foregoing compression is continued, pressure in the case is raised at positions near the developing roller. As a result, toner on the developing roller cannot be restrained by the restraining blade, which leads to an excess conveyance of toner that causes undesirable changes in the density of the image and also causes undesirable toner leaks.

The above problems are exacerbated when color toner is used. Color toner generally has fluidity inferior to that of black toner. Specifically, color toner contains resin of a type having a multiplicity of low-molecular-weight components in order to realize color transmissivity and a dispersant for uniformly dispersing color pigment. The foregoing components deteriorate the fluidity of the toner. If color toner having poor fluidity is continuously conveyed in the above-mentioned developing unit, excess toner cannot be returned from the supply roller, which makes the state of compression more critical.

Additional problems with the conventional developing unit arise when color toner is used. The foregoing electrophotographic process using color toner is performed in such a manner that four developing units, for forming yellow, magenta, cyan and black images, are disposed in the apparatus. The use of four developing units increases the size of the apparatus so that it is much larger than an apparatus for forming a monochrome image. To decrease the size of the apparatus, the density of pigment in each toner particle must be increased to reproduce a required image density with a smaller quantity of toner. By using a smaller quantity of toner, the capacity of the toner case can be reduced.

However, if the pigment component in the toner is increased, the fluidity of the toner generally deteriorates, thus causing a great rotational load on the conveying fin. The increased load on the conveying fin undesirably changes the necessary torque to drive the conveying fin which in turn causes undesirable changes in the rotation of the motor which drives the conveying fin. As a result, jitters appear in the formed image.

Increasing the pigment component in the toner also raises the area ratio of the pigment component on the surface of the matrices of toner particles in general. Toner must have a certain polarity and be frictionally electrified by an electrified member having a polarity opposite to the polarity of toner (such as a developing roller or a restraining blade) so that the electrification of toner is stabilized. If toner particles have pigment in a large quantity on their surfaces, the electrified members (such as the developing roller and the restraining blade) easily encounter filming attributable to mechanical contact and sliding. If the electrified member having the same polarity as that of toner encounters filming, the electrification characteristic of toner deteriorates and becomes instable. As a result the density of the formed image is lowered and the toner supply characteristic deteriorates.

Further problems arise in the above-mentioned conventional developing unit when trying to reduce its size. The center or rotation of the conveying fin in the conventional developing unit is disposed lower than the center of rotation of the supply roller in an attempt to reduce the thickness of the developing unit by efficiently creating a space for accommodating toner. However, such an arrangement suffers the problem that the conveying fin scrapes insufficient toner up to the surface of the toner supply roller thereby causing an undesirably low density in the formed image.

OBJECTS OF THE INVENTION

One object of the present invention is to provide a developing unit which is capable of reducing the torque necessary to drive the supply roller. A further object of the present invention is to provide a developing unit capable of reducing torque required to rotate the supply roller. It is also an object of the present invention is to provide a developing unit which prevents an increase in the torque required to rotate the developing roller and prevents leakage of toner. Yet another object of the present invention is to provide a developing unit which is capable of conveying toner without change in torque even if toner having poor fluidity, such as toner having a high density, is used.

Another object of the present invention is to provide a developing unit capable of protecting a photosensitive member from being damaged and exhibiting an excellent sealing characteristic.

Another object of the present invention is to provide a developing unit having a seal which does not damage the photosensitive member.

Still another object of the present invention is to provide a developing unit capable of preventing compression of toner in a case wherein the compression is due to conveyance performed by a conveying member. It is also an object of the present invention to prevent excess conveyance of toner.

A further object of the present invention is to provide a developing unit which is capable of ensuring that the conveying fin satisfactorily conveys toner.

Another object of the present invention is to provide a developing unit which is capable of preventing the occurrence of filming to the developing roller and the restraining blade even if dense toner is used.

SUMMARY OF THE INVENTION

To achieve the above-mentioned objects, the developing unit of the present invention includes a case for accommodating toner; a developing roller rotatably supported by the case by dint of a shaft; and a supply roller rotatably supported by the case by dint of a shaft and formed of an elastic member arranged to be pressed against the surface of the developing roller in such a manner as to supply toner to the surface of the developing roller. In the present invention, the elastic member which forms the supply roller is an expanded material having a ratio of open cells of 30% or higher, the depth of engagement of the supply roller to the developing roller is 0.4 mm or smaller, and the toner has a shape factor SF-1 of 150 or smaller and a shape factor SF-2 of 140 or smaller. As a result, even if toner is introduced into the cells formed in the surface of the supply roller, the cells in the surface are not clogged as has been experienced with the closed-cell expanded material. Moreover, toner introduced into the cells can easily be discharged from the cells. Therefore, the undesirable rise in the hardness of the supply roller over time, as has been experienced with the conventional structure, is prevented. By preventing the hardening of the supply roller, the torque required to rotate the supply roller can be reduced.

Additionally, corner portions of the supply roller can be chamfered. When the corner portions of the supply roller are chamfered, even if the elastic portion of the supply roller pressed against the developing roller is dented, the projecting portions do not project sideways over the side surface of the supply roller. Since the projecting portions are not engaged with the sealing member as has been experienced with the conventional technique, the drive torque required to rotate the supply roller is reduced.

To further achieve the above-mentioned objects, the developing unit of the present invention includes a developing roller having a chamfered end portion on the surface for conveying toner. Therefore, the end portion of the developing roller does not come in contact with the photosensitive member. Thus any damage to the photosensitive member, which occurs due to contact and sliding of the edge of the end portion of the developing roller, is prevented. Since the quantity of elastic displacement of the sealing member is made lager than the quantity of chamfering of the end portion of the developing roller, the sealing member is able to flexibly follow the chamfered portion of the developing roller. As a result, leakage of toner from the chamfered portion is prevented. Thus, the characteristic for sealing toner can further be improved.

To further achieve the above-mentioned objects, the developing unit of the present invention also includes a restraining blade for restraining a quantity of toner on the developing roller wherein the restraining blade is at least longer than a surface of the developing roller for conveying toner. Therefore, toner on the overall surface of the developing roller is uniformly restrained by the restraining blade thereby preventing any defect of the toner seal which is caused from toner excessively conveyed from the surface of the developing roller or free toner which appears attributable to an excess conveyance of toner. Moreover, because toner is uniformly formed over the surface of the developing roller for conveying toner, therefore the toner serves as a lubricant between the photosensitive member and the developing roller. As a result, damage of the photosensitive member is reduced.

To further achieve the objects of the invention, the developing unit of the present invention also includes a sealing member disposed on the side ends of the developing roller and the supply roller so as to prevent leakage of toner from the shaft portion. Since the developing unit according to the present invention has the seals disposed at the ends of the developing roller, introduction of toner from the surface of the developing roller for conveying toner into the side end of the developing roller is prevented. The sealing portion of the developing roller does not damage the photosensitive member as has been experienced with the conventional structure and the present invention achieves excellent toner sealing.

Further, a quantity of elastic displacement of the sealing member is larger than a quantity of chamfering of the end portion of the developing roller. Because the quantity of elastic deformation of the sealing member is larger than the difference between the length of the restraining blade and the length of the surface of the developing roller, the sealing member flexibly follows a stepped portion generated by the difference in the length between the developing roller and the restraining blade. Thus, leakage of toner from the stepped portion is prevented, and the characteristic for sealing toner is further improved.

The surface roughness of the side surface of the developing roller is 0.5 $\mu$m or smaller in Rmax. If the surface roughness of the side surface of the developing roller exceeds 0.5 $\mu$m in Rmax, toner is undesirably held on the side surface of the developing roller, and is undesirably conveyed thereby when the developing roller is rotated. Thus, toner leaks to the outside portion of the developing unit.

Because the side surfaces of the developing roller of the present invention have a surface roughness of 0.5 $\mu$m or smaller in Rmax, toner is not held thereon and is not conveyed thereby when the developing roller is rotated. Therefore, introduction of toner between the side surface of the developing roller and the sealing member as has been experienced with the conventional structure is prevented, which in turn prevents leakage of toner to the outside portion of the developing unit.

Moreover, the sealing member is in the form of a film which is allowed to abut against the developing roller, and a quantity $\delta$ of displacement of the sealing member occurring attributable to the abutment of the sealing member against the developing roller satisfies $0.1\ \text{mm}<\delta<0.8\ \text{mm}$. Therefore, toner is not scraped down by the sealing member when the developing roller holding toner passes through the developing position and is then recovered in the developing unit.

Since the quantity $\delta$ of displacement of the sealing member satisfies $0.1\ \text{mm}<\delta$, the sealing member is always brought into contact with the overall region of the developing roller in the lengthwise direction even if the deflection of the developing roller is tens of μm. Thus, leakage of toner to the outside portion of the developing unit is prevented.

Because the quantity δ of displacement of the sealing member satisfies δ<0.8 mm, the torque required to rotate the developing roller is not substantially increased when the sealing member is brought into contact with the developing roller. Therefore, leakage of toner is prevented even if images are formed quickly as in the conventional structure. Moreover, increase in the torque required for rotating the developing roller is prevented.

To achieve the above desired displacement of the sealing member, the thickness t of the sealing member satisfies 50 μm<t<500 μm. Since the thickness t of the sealing member satisfies 50 μm<t, satisfactory printing durability can be realized. After a multiplicity of sheets have been printed, the force of contact of the sealing member with the developing roller is not substantially changed, and thus, toner is not leaked to the outside portion of the developing unit.

Since the thickness t of the sealing member satisfies t<500 μm, the torque required to rotate the developing roller is not substantially enlarged when the sealing member is brought into contact with the developing roller.

To further achieve the above mentioned objects, a developing unit of the present invention also includes a conveying member which comprises at least one or more conveying fins each having a fin shape and being rotatably supported by the case by dint of a shaft in such a manner as to convey toner to the surface of the supply roller. Thus, toner accommodated in the case is conveyed to the surface of the supply roller by dint of mechanical conveying force generated when the conveying fins are rotated. The conveying fins are lightly in contact with the case therefore toner placed on the conveying fins and that placed between the conveying fins and the case is conveyed to the surface of the supply roller.

Since each conveying fin has the fin-type shape as described above, toner is continuously supplied. As an alternative to this, toner can be intermittently supplied to the supply roller, which would prevent an excess conveyance of toner.

The conveying fin is disposed in such a manner that the angle θ made between the line connecting the center of rotation of the supply roller to the center of rotation of the conveying fin and a horizontal line is in a range from −20 degrees to +75 degrees, wherein a clockwise direction of rotation has positive values with respect to a horizontal direction. Therefore, toner on the conveying fin and that between the conveying fin and the case can easily be scraped up to the surface of the supply roller.

If angle θ is −20 degrees or smaller, toner on the conveying fin and that placed between the conveying fin and the case cannot be scraped up to the surface of the supply roller. Even if toner is scraped up to the surface of the supply roller, if the structure has no support roller for supporting toner in the direction of gravity then toner on the supply roller will drop off. Thus, toner cannot satisfactorily be conveyed.

If the angle θ is 75 degrees or larger, toner on the conveying fin and toner placed between the conveying fin and the case are excessively conveyed to the supply roller portion. Thus, toner is compressed excessively among the supply roller, the developing roller and the restraining blade. As a result, the restraining blade cannot appropriately restrain toner on the developing roller and toner leaks from the restraining portion.

The developing unit of the present invention is thus able to prevent the defect in conveyance which takes place with the conveying fin of the conventional structure.

Alternatively, the angle θ made between the line connecting the center of rotation of the supply roller to the center of rotation of the conveying fin and the horizontal line can be in a range from −20 degrees to 0 degrees. In such an arrangement, the conveying fin is supported so that it is displaced and brought into contact with the case, and so that it is rapidly displaced and released from the case at a portion adjacent to the supply roller. Therefore, a larger force is produced for elastically discharging toner on the conveying fin and toner placed between the conveying fin and the case.

Therefore, a large quantity of toner which must be conveyed can be elastically discharged to the surface of the supply roller. As a result, the efficiency of conveying toner to the surface of the supply roller is improved.

In the developing unit of the present invention when the angle θ made between the line connecting the center of rotation of the supply roller to the center of rotation of the conveying fin and the horizontal line is in a range from −20 degrees to 0 degree, an apparent density (hereinafter called an A.D) of toner used is 0.3 g/cc or higher to improve the toner conveying the efficiency. As a result of using toner of the foregoing type, toner is easily scraped up by the conveying fin and conveyed from the conveying fin to the supply roller. Thus, toner does not easily drop from the surface of the supply roller, and the toner conveying efficiency is further improved.

If the A.D of toner is lower than 0.3 g/cc, the toner has poor fluidity and cannot be easily scraped up by the conveying fin to the surface of the supply roller.

If the A.D of toner is 0.5 g/cc or higher, excessive fluidity is realized and toner scraped up by the conveying fin to the surface of the supply roller easily comes off the supply roller.

The developing roller, the supply roller and the conveying fins are sequentially disposed in a horizontal direction and the number of revolutions of the conveying fins is not less than 1/50 of the number of revolutions of the supply roller nor more than 1/20 of the same. Since the conveying fins are structured to rotate in such a manner, excessive conveyance of toner to the supply roller portion by the conveying fins is further prevented.

If the number of revolutions of the conveying fins is larger than 1/20 the number of revolutions of the supply roller, the amount of toner conveyed by the conveying fins is in excess of that which is consumed by the developing roller and the supply roller. Thus, toner is brought to the compressed state. In the compressed state, toner is moved before the excess portion of toner conveyed is returned to the conveying fins, thus the state of compression becomes more critical.

If the number of revolutions of the conveying fins is smaller than 1/50, the number of revolutions of the supply roller, the quantity of toner which is conveyed by the conveying fins is insufficient to compensate the quantity of toner which is consumed by the developing roller and supply roller portions. The developing unit of the present invention thus prevents excessive compression of toner and also prevents defects in conveyance caused by the conveying member.

In another embodiment of the present invention, at least two or more conveying fins are rotatably supported by the case by dint of a shaft, and the phases of rotation of the conveying fins are different from one another. Further, the number of revolutions of a conveying fin nearest the supply roller is larger than the number of revolutions of any other conveying fin. Therefore, toner in the case is slowly conveyed to the supply roller portion. As a result, compression of toner in the supply roller portion is prevented. Since the conveying fin nearest the supply roller has a higher number of revolutions, the insufficient conveyance of toner can be prevented and the developing unit of the present invention is further able to prevent compression of toner by the conveying fins.

Specifically, the fins are formed by thin flexible plates (in the form of sheets). The fins are rapidly displaced and released from the wall surface of the case at a position adjacent to the supply roller. More specifically, when the fin is separated from the wall surface of the toner reservation portion, toner conveyed while being held in a wedge-shape space formed between the fin and the case is elastically discharged by the elasticity of the fins. To achieve this elastic discharge, the quantity of displacement between the fin and the wall surface is enlarged. The force for discharging toner depends on the rigidity (the elasticity) of the fin.

Since the phases of rotation of the conveying fins are different from one another, the change in the load occurring attributable to the elastic discharge of toner performed by the conveying fin is dispersed. Thus, even if dense toner having poor fluidity is used, the load of the conveying fins is uniformly distributed and undesirable change in the torque in the apparatus can be prevented.

The toner of the present invention contains pigment by 5 wt % or more, and a ratio of a toner additive having a small diameter covering the surfaces of matrices of toner is 100% or higher. Therefore, even if a large quantity of pigment exists on the surfaces of the matrices of the toner, the additive having a relatively small diameter surrounds the pigment. Consequently, the pigment existing on the surfaces of the matrices does not come in contact with an electrified member (such as the developing roller or the restraining blade) and does not slide on the same. Thus, the electrified member is free from filming. Because the additive having a relatively small diameter is usually made of an inorganic material having high hardness, the additive does not allow the electrified member to easily encounter filming even if mechanical contact and sliding take place. Thus, filming of the pigment of toner to the electrified members is prevented.

The size of a record toner additive having a large diameter is not smaller than ½ of the diameter of the pigment. Thus, again even if a large quantity of the pigment exists on the surfaces of the matrices of toner particles, the additive having a relatively large diameter projects over the surfaces of the matrices of the particles covers the surfaces of the pigment. Therefore, the pigment existing on the surface of the matrices of the toner particles does not come in contact with the electrified members, such as the developing roller and the restraining blade. Thus, filming of the electrified members is prevented. The reason ½ is employed is because the maximum value of the quantity of projection of the pigment over the surfaces of the matrices of the particles is ½. Pigment projecting by the quantity exceeding ½is separated during the process for manufacturing toner and thus does not exist. Therefore, contact of the pigment with the electrified members is prevented if the particle size of the additive covering the pigment is ½ or larger.

When the size of the large diameter toner additive is larger than ½ the diameter of the pigment, the ratio of the additive covering the surfaces of matrices of particles is not larger than 10%. Therefore, the additive is able to uniformly and fully cover the pigment even if a large quantity of the pigment exists on the surfaces of the matrices of toner particles, and filming to the electrified members is further prevented.

Moreover, an apparent density (hereinafter called an A.D) of the-toner is 0.3 g/cc or higher.

Accordingly, in the developing unit of the present invention, torque required to rotate the supply roller is reduced, and toner is prevented from leaking out of the developing unit. Even toner, such as dense toner, having poor fluidity is conveyed without any change in the torque, and an image free from jitters is formed. Also, the developing unit prevents leakage of toner even after a multiplicity of images has been printed. Further in the developing unit, the photosensitive member is not damaged by the end portion of the surface of the developing roller and the sealing characteristic is improved. Moreover, in the developing unit, undesirable compression of toner in the case which occurs due to conveyance performed by the conveying member is prevented. Thus, change in the density of a formed image is prevented. Further, the developing unit prevents filming of the pigment of toner to the electrified members (such as the developing roller and the restraining blade) even if toner, such as dense toner, containing a large quantity of pigment is employed. Finally, in the developing unit of the present invention, the conveying fin is able to efficiently convey toner even if the developing roller, the supply roller, and the conveying fin are sequentially disposed in the horizontal direction. Thus, the densities of formed images are stabilized.

DETAILED DESCRIPTION OF THE INVENTION

Embodiments of the present invention will now be described with reference to the drawings.

First Embodiment

Figure 1:
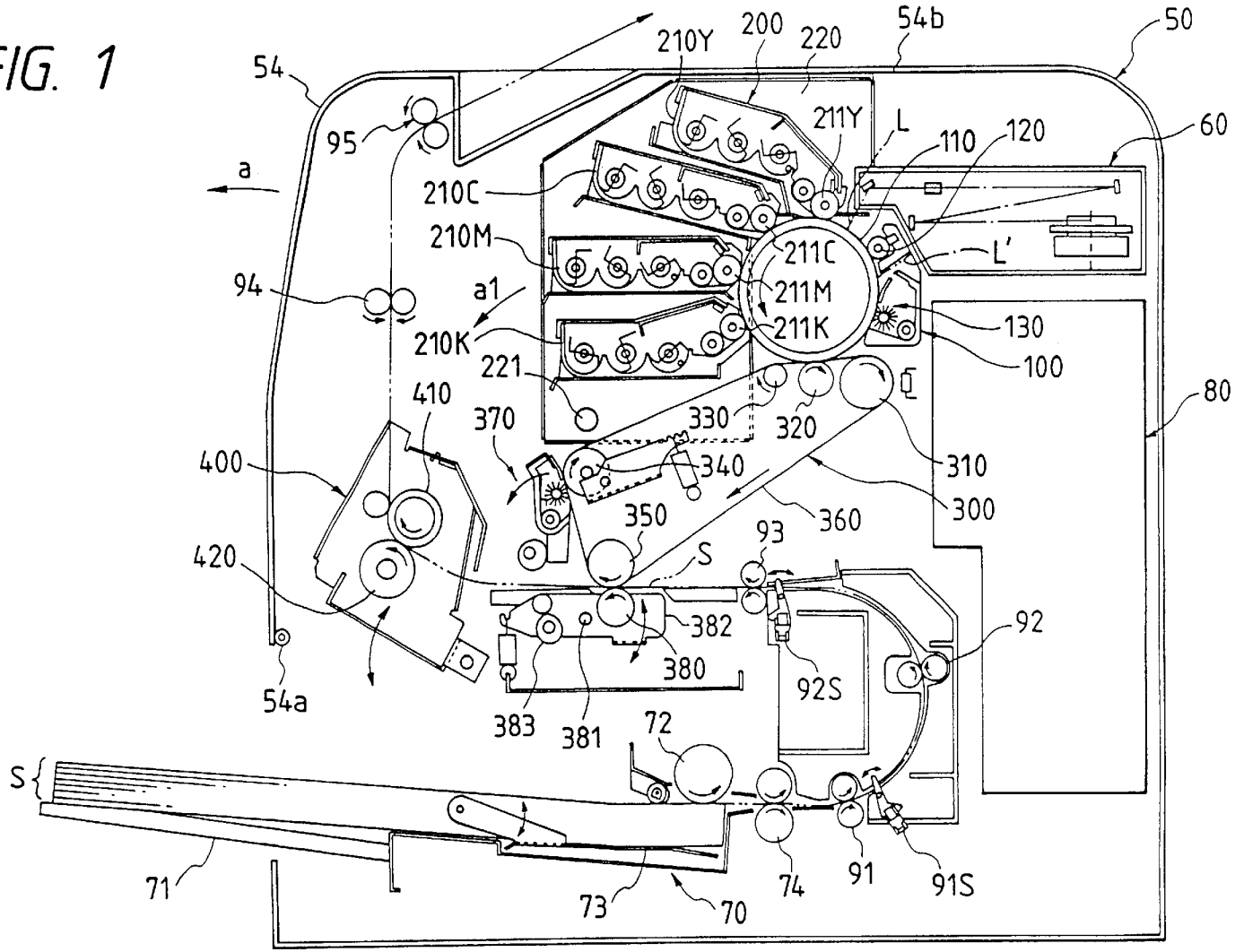
FIG. 1 is a schematic view showing an example of an image forming apparatus having a developing unit according to a first embodiment of the present invention.

FIG. 1 is a schematic view showing an example of an image forming apparatus including a developing unit according to a first embodiment of the present invention.

Initially, the schematic structure of the image forming apparatus will be described, and then a developing apparatus and a developing unit accommodated in the developing apparatus will be described.

The image forming apparatus of the present invention is arranged to use a developing unit including toner in four colors which are yellow, cyan, magenta and black. Thus, the image forming apparatus is able to form a full color image.

Referring to FIG. 1, reference numeral 50 represents a case of the body of the apparatus. In the case 50, there is disposed an exposing unit 60, a paper-feeder unit 70, a photosensitive unit 100, a developing unit 200, an intermediate transfer unit 300, a fixing unit 400, and a control unit 80 for totally controlling the apparatus.

The photosensitive unit 100 has a photosensitive member 110, a charging roller 120 serving as a charging device which is brought into contact with the outer surface of the photosensitive member 110 to uniformly electrostatically charge the outer surface, and a cleaning device 130.

The developing unit 200 includes a yellow developing unit 210Y, a cyan developing unit 210C, a magenta developing unit 210M and a black developing unit 210K. The yellow, cyan, magenta and black developing units 210Y, 210C, 210M and 210K respectively accommodate yellow, cyan, magenta and black toner and respectively include developing rollers 211Y, 211C, 211M and 211K. Any one of the developing rollers of the developing units can be brought into contact with the photosensitive member 110.

The intermediate transfer unit 300 has a drive roller 310, a primary transfer roller 320, a crease-removing roller 330, a tension roller 340, a backup roller 350, an intermediate belt 360 in the form of an endless belt arranged among the foregoing rollers, and a cleaning device 370 which can be brought into contact with the intermediate belt 360 and separated therefrom.

A secondary transfer roller 380 is disposed opposite to the backup roller 350. The secondary transfer roller 380 is rotatably supported by an arm 382 which is supported by a support shaft 381 in such a manner that the arm 382 is able to swing. When the arm 382 is swung by dint of the operation of the cam 383, the secondary transfer roller 380 is brought into contact with the intermediate belt 360 or separated therefrom.

A gear (not shown) is secured to the end of the drive roller 310. Since the gear is engaged to a gear (not shown) of the photosensitive unit 100, the drive roller 310 is rotated at substantially the same circumferential speed as that of the photosensitive member 110. Therefore, the intermediate belt 360 is circulated at substantially the same circumferential speed as that of the photosensitive member 110.

During the circulation of the intermediate belt 360, the toner image on the photosensitive member 110 is transferred to the surface of the intermediate belt 360 at a position between the primary transfer roller 320 and the photosensitive member 110. The toner image transferred to the surface of the intermediate belt 360 is transferred to a recording medium S supplied between the intermediate belt 360 and the secondary transfer roller 380. The recording medium S is supplied from the paper-feeder unit 70.

The paper-feeder unit 70 has a tray 71 on which a plurality of stacked recording mediums S are placed, a pickup roller 72, a hopper 73 for pushing the recording medium S placed on the tray 71 toward the pickup roller 72 and a separation roller pair 74 for sequentially and reliably separating paper sheets supplied by the pickup roller 72.

The recording medium S supplied from the paper-feeder unit 70 is allowed to pass through a first conveyance roller 91, a first paper sensor 91S, a second conveyance roller pair 92, a second paper sensor 92S and a gate roller 93. Then, the recording medium S is supplied to the second transfer portion, that is, a position between the intermediate belt 360 and the secondary transfer roller 380. Then, the recording medium S is allowed to pass through the fixing unit 400, the first discharge roller pair 94 and the second discharge roller pair 95, and then discharged to the upper surface of the case 50.

The fixing unit 400 has a fixing roller 410 having a heat source and a pressing roller 420 pressed against the fixing roller 410.

The operation of the image forming apparatus will now be described.

(i) When a print instruction signal (an image forming signal) is supplied from a host computer (a personal computer or the like, not shown) to the control unit 80, the photosensitive member 110, the developing rollers of the developing unit 200 and the intermediate belt 360 are rotated.

(ii) The outer surface of the photosensitive member 110 is uniformly electrostatically charged by the charging roller 120.

(iii) The outer surface of the photosensitive member 110, which has uniformly been electrostatically charged, is subjected to a selective exposure L corresponding to image information of a first color (for example, yellow) by the exposing unit 60. Thus, an electrostatic latent image for a yellow image is formed.

(iv) Only one developing roller 211Y of the developing unit 210Y for the first color (for example, yellow) is brought into contact with the photosensitive member 110. Thus, the electrostatic latent image is formed so that a toner image in the first color (for example, yellow) is formed on the photosensitive member 110.

(v) The toner image formed on the photosensitive member 110 is transferred to the surface of the intermediate belt 360 in the primary transfer portion, that is, at the position between the photosensitive member 110 and the primary transfer roller 320. At this time, the cleaning device 370 and the secondary transfer roller 380 are separated from the intermediate belt 360.

(vi) Toner left on the photosensitive member 110 is removed by the cleaning device 130, and then the photosensitive member 110 is destaticized with destaticizing light beam. L' emitted from a destaticizing device 61 shown in FIG. 2.

(vii) The foregoing operations (ii) to (vi) are repeated as necessary. That is, in accordance with the contents of the printing instruction signals, the operations for the second, third, and fourth colors are repeated. As a result, toner images corresponding to the contents of the printing instruction signals are stacked and formed on the intermediate belt 360.

(viii) The recording medium S is supplied from the paper-feeder unit 70 at predetermined timing. Immediately before the leading end of the recording medium S reaches the second transfer portion or after it has reached the second transfer portion (that is, at the time when the toner image on the intermediate belt 360 is transferred to a required position on the recording medium S), the secondary transfer roller 380 is pressed against the intermediate belt 360. As a result, the toner images which make up a full color image on the intermediate belt 360 are transferred to the surface of the recording medium S. Moreover, the cleaning device 370 is brought into contact with the intermediate belt 360 so as to remove toner left on the intermediate belt 360 after the second transfer has been performed.

(ix) Since the recording medium S passes through the fixing unit 400, the toner images are fixed on the recording medium S. Then, the recording medium S is allowed to pass through the discharge roller pairs 94 and 95, to be discharged on the case 50.

The developing unit 200 will now be described. As shown in FIG. 1, the developing unit 200 has a frame 220 having an inverted L-shape and four developing units 210 (Y, C, M and K) detachably accommodated in the frame 220. The frame 220 of the developing unit 200 is, by dint of a shaft 221, enabled to rotate in a direction indicated with an arrow "al" (counterclockwise). When the frame 220 is rotated clockwise, it is locked at the position shown in FIG. 1.

Also the cover 54 of the case 50 can be opened in a direction indicated by an arrow "a" by dint of a hinge 54*a*, wherein reference numeral 54*b* represents an end of the cover 54. When the cover 54 is opened, any developing unit 210 can be attached or detached in substantially the horizontal direction with respect to the frame 220 without rotation of the frame 220. When the cover 54 and the developing unit 200 are open, in the directions indicated by the arrows "a" and "al", the photosensitive unit 100 can be attached or detached.

Figure 2:
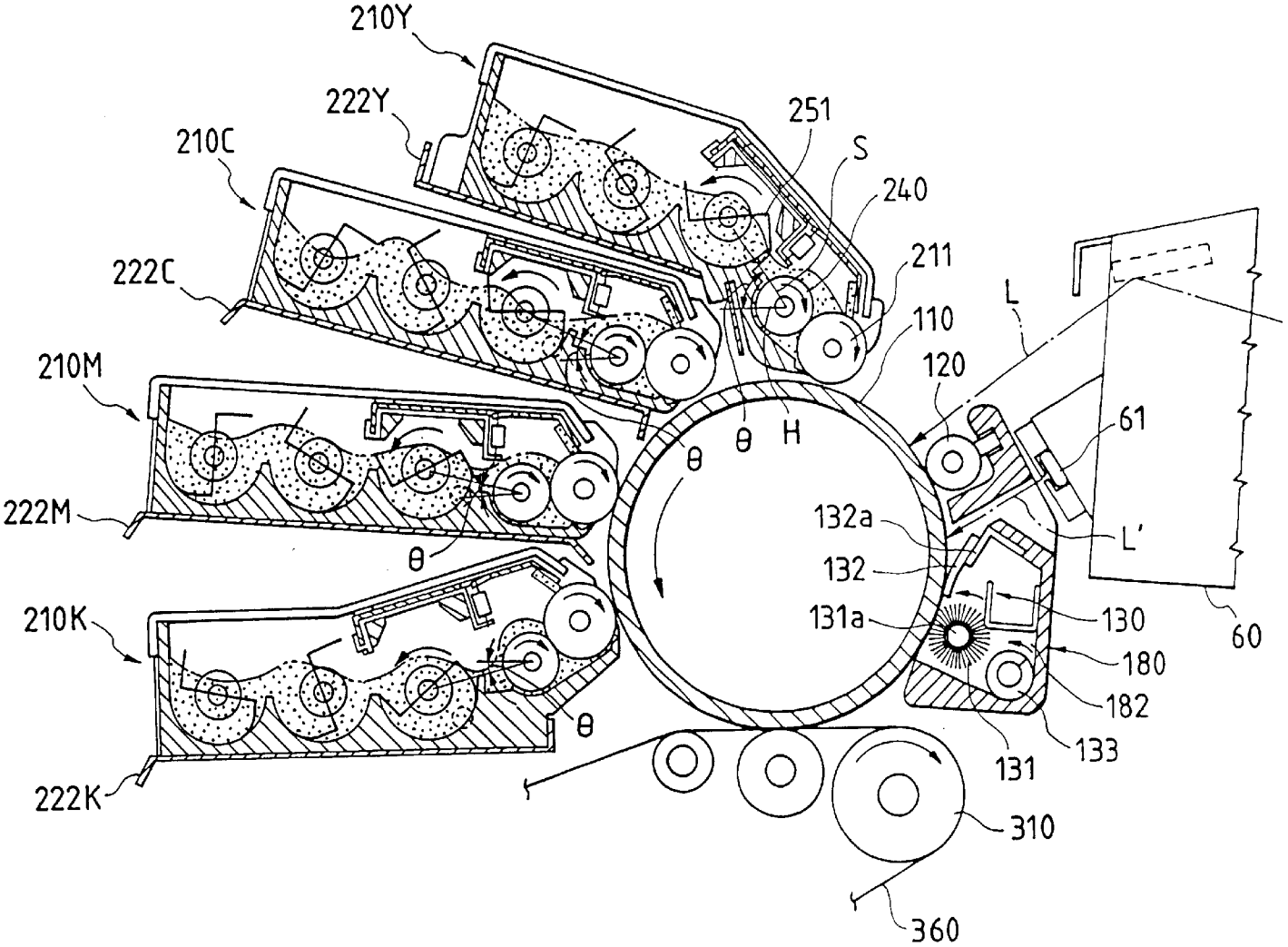
FIG. 2 is an enlarged view of four developing units 210, a photosensitive member 110 and their vicinity.

FIG. 2 is an enlarged view of the four developing units 210 (Y, C, M and K), the photosensitive member 110 and the surrounding vicinity. The four developing units 210 (Y, C, M and K), having somewhat different shapes, are basically structured identically. Therefore, the developing unit 210M for developing a magenta image will be described as a representative unit. Initially, the structure of the developing unit 210 will be described mainly with reference to FIG. 3.

The developing unit 210 has a case 230, toner T accommodated in the case 230, a developing roller 211 for supplying toner T to the surface of the photosensitive member 110, a supply roller 240 for supplying toner T to the developing roller 211, three conveying fins 251, 252 and 253 for conveying toner T toward the supply roller 240 and a restraining blade 260 pressed against the developing roller 211 so that the quantity of toner is restrained. Moreover, the developing unit 210 has a sealing member 270 (FIG. 5(*a*)) for preventing leakage of toner between the shafts of the developing roller, the supply roller, the conveying fins, and the case. The case 230 has a case body 231 and a cover 222.

Main characteristics of toner for use in the present invention will now be described. Toner is typically prepared in such a manner that pigment, CCA (Charge Control Agent) and wax are bound with synthetic resin. Moreover, an additive having a relatively large diameter for mainly realizing durability and another additive having a relatively small diameter for realizing fluidity are added to the surface realized by the binding process.

In the present invention, the toner components and characteristic of the components were determined as follows.

(1) Synthetic Resin

The synthetic resin is polyester to improve the fixing characteristic.

(2) Particle Size

The particle size of toner is not less than 6 $\mu$m nor more than 9 $\mu$m .

If the particle size is 6 $\mu$m or smaller, the cleaning characteristic deteriorates and the cost cannot be reduced. If the particle size is 9 $\mu$m or larger, the resolution deteriorates. In this embodiment, the particle size is 7 $\mu$m.

(3) Pigment

The particle size of the pigment may be 30 nm to 50 nm. In this embodiment, pigment having particle size of about 50 nm is employed. The quantity of the pigment is made to be not less than 5 wt % nor more than 15 wt %. The reason for this is that the capacity of the hopper must be reduced while the density of the formed image is maintained so as to reduce the size of the developing unit 210. If the pigment quantity exceeds 15 wt %, the supply characteristic deteriorates because the electrification characteristic deteriorates to the point where filming of the developing roller and filming of the blade easily take place.

(4) CCA

The quantity of the CCA is made not less than 0.5 wt % nor more than 3 wt %. To improve the electrification characteristic, the quantity of CCA must be 0.5 wt % or more. If the quantity of CCA exceeds 3 wt %, the transfer characteristic deteriorates.

(5) Wax

The quantity of the wax is 0.5 wt % or larger. This improves the separation characteristic of toner from the fixing roller. Moreover, the fixing strength of toner to a recording medium, such as paper, is strengthened.

(6) Additive Having Relatively Large Diameter

An additive having a large diameter is silicon oil having a particle size of about 40 nm which is larger than ½ of the particle size of the pigment. The quantity of the additive is not less than 0.5 wt % nor more than 5 wt %.

To ensure that the additive having the small diameter is not embedded in the matrices, the additive having the large diameter must be 0.5 wt % or more. However, if the quantity of the additive having the large diameter exceeds 5 wt %, the supply characteristic deteriorates because the fluidity deteriorates.

In the present invention, the size of the additive having the large diameter to toner is larger than ½ of the diameter of the pigment, therefore even if a large quantity of the pigment exists on the surfaces of the matrices of toner particles, the additive having the large diameter projects over the pigment surfaces of the matrices of the particles so that they do not come in contact with the electrified members. Since the additive having the large diameter is usually an inorganic material having a high hardness, filming of the same to the electrified members does not easily take place from mechanical contact or friction. Therefore, filming of the pigment of toner to the electrified members is prevented.

In developing unit of the present invention the ratio of the additive having the large diameter covering matrices of particles is not lower than 10%. Specifically, the quantity of the additive having the large diameter is contained by 0.5 wt % or larger. As a result, the ratio of the additive having the large diameter covering the surfaces of the matrices of the toner particles can be made to be 10% or more.

The covering ratio of the additive is obtained from the following equation:

$$\text{Covering Ratio } \gamma = \sum_{i=1}^{n}\left(\frac{1R\rho Wi}{\pi ri\rho i100}\right)$$

where R: outer diameter of matrices of toner ri: outer diameter of additive i

ρ: density of matrices of additive

ρi: density of additive i

Wi: quantity of addition of additive i to matrices of toner (wt %)

i: i-th additive n: number of types of additives

Since the ratio of the additive covering the surfaces of the matrices of the particles is 10% or higher, the additive is able to substantially fully cover the pigment even if a large quantity of the pigment exists on the surfaces of the matrices of the toner particles. Thus, filming of the pigment of toner to the electrified members is prevented.

(7) Additive Having Relatively Small Diameter

In this embodiment, an additive having a small diameter is used to improve the fluidity of toner. The additive having the small diameter is hexamethdisilanzane (HMDS) having a particle size of about 14 nm. The quantity is not less than 1.0 wt % nor more than 3 wt %. The reason for this lies in that 1.0 wt % or more is required for the small diameter additive (in terms of the projected area of the additive) to cover 100% or more the surface, that is, to cover substantially all the surfaces of the toner particles.

The covering ratio of the additive is again obtained from the above equation.

If the quantity is 3 wt % or larger, the fixing characteristic deteriorates.

In the present invention, the ratio of additive having the small diameter covering the matrices of toner accommodated in the case is 100% or higher. Therefore, even if a large quantity of the pigment exists on the surfaces of the matrices of toner, the additive covers the pigment. Therefore, the pigment existing on the surfaces of the matrices of toner does not directly come in contact with or slide on the electrified members, such as the developing roller and the restraining blade. As a result, the electrified members are free from filming. Because the additive having a small diameter is usually made of an inorganic material having a high hardness, filming of the additive to the electrified member does not take place during mechanical contact and sliding. Thus, filming of the pigment of toner to the electrified members is prevented.

Figure 4:
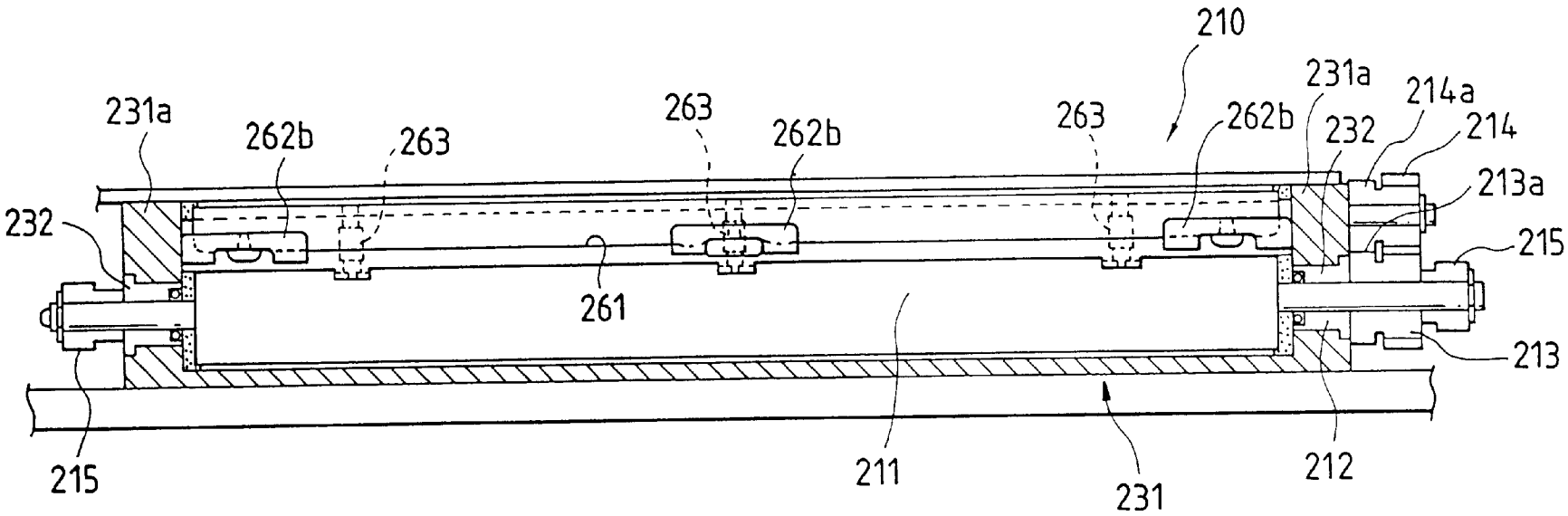
FIG. 4 is a partially-cut cross sectional view taken along line IV—IV shown in FIG. 3.

As shown in FIG. 4, the developing roller 211 is structured in such a manner that the surface of the developing roller 211 for conveying toner is shorter than the restraining blade 260. Moreover, the developing roller 211 has a shaft 212 which is rotatably supported by side walls 231*a* of the case body 231 through bearings 232. A gear 213 for rotating the developing roller 211 is secured to an end of the shaft 212. A transmission gear 214 for transmitting drive torque supplied from a torque source (not shown) is engaged with the gear 213. A roller 215 is rotatably disposed at the two ends of the shaft 212. The roller 215 is brought into contact with flanges (not shown) formed at the two ends of the photosensitive member 110 when the developing roller 211 is brought into contact with the photosensitive member 110 to restrain the position of the developing roller 211 with respect to the photosensitive member 110.

Figure 3:
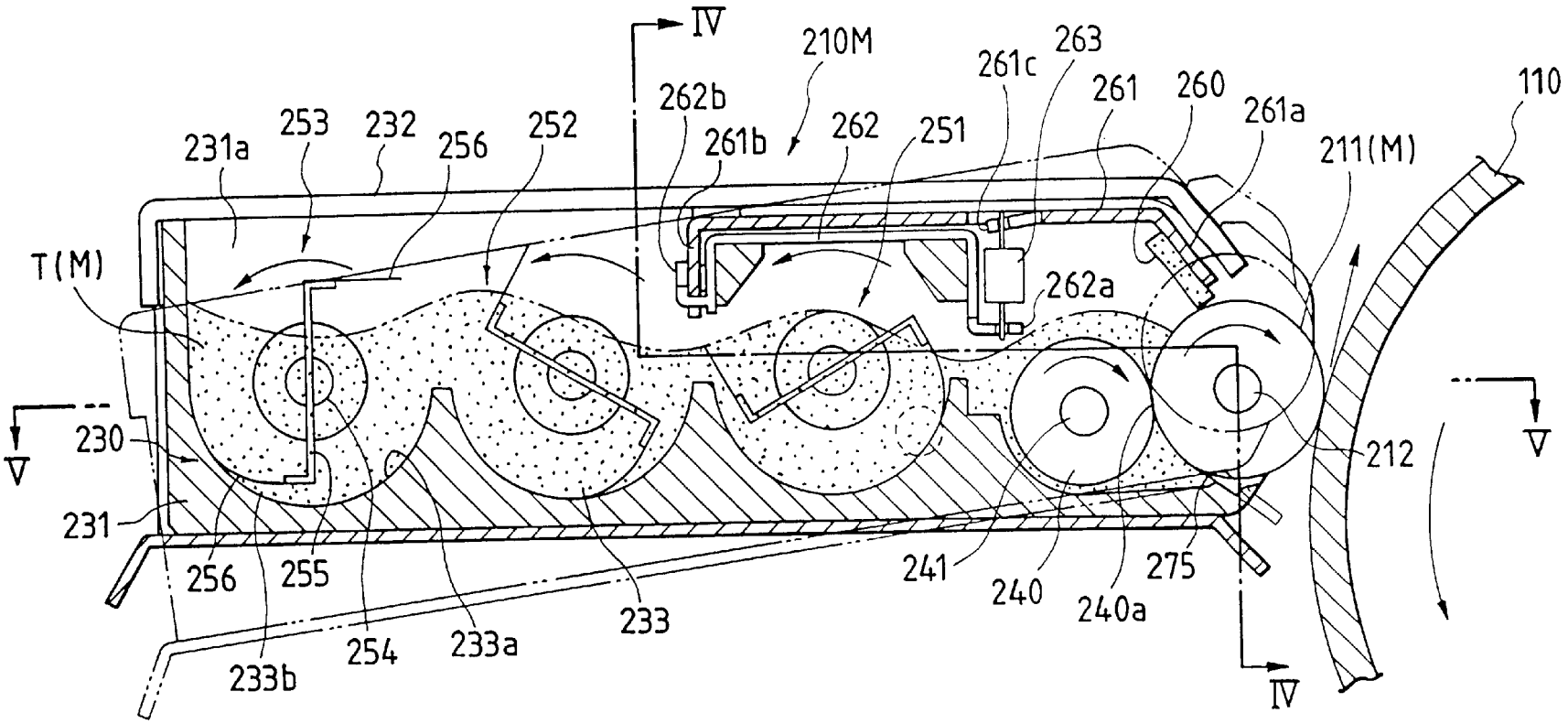
FIG. 3 is an enlarged view of a portion including a developing unit 210M.

As described above, the restraining blade 260 is longer than the surface of the developing roller 211 for conveying toner. The restraining blade 260 is secured to a leading end 261*a* of a support plate 261. As shown in FIG. 3, the support plate 261 has a bent rear end 261*b* supported by three hook portions 262*b* (see FIG. 4) of a base plate 262 secured to the case body 231. Thus, the support plate 261 is able to swing relative to the support portion. The support plate 261 is urged in such a manner that the support plate 261 presses the developing roller 211 of the restraining blade 260 by at least two (three in the structure shown in the drawing) tension springs 263 disposed between an intermediate portion 261*c* of the support plate 261 and a front portion 262*a* of the base plate 262.

Figures 5A, 5B:
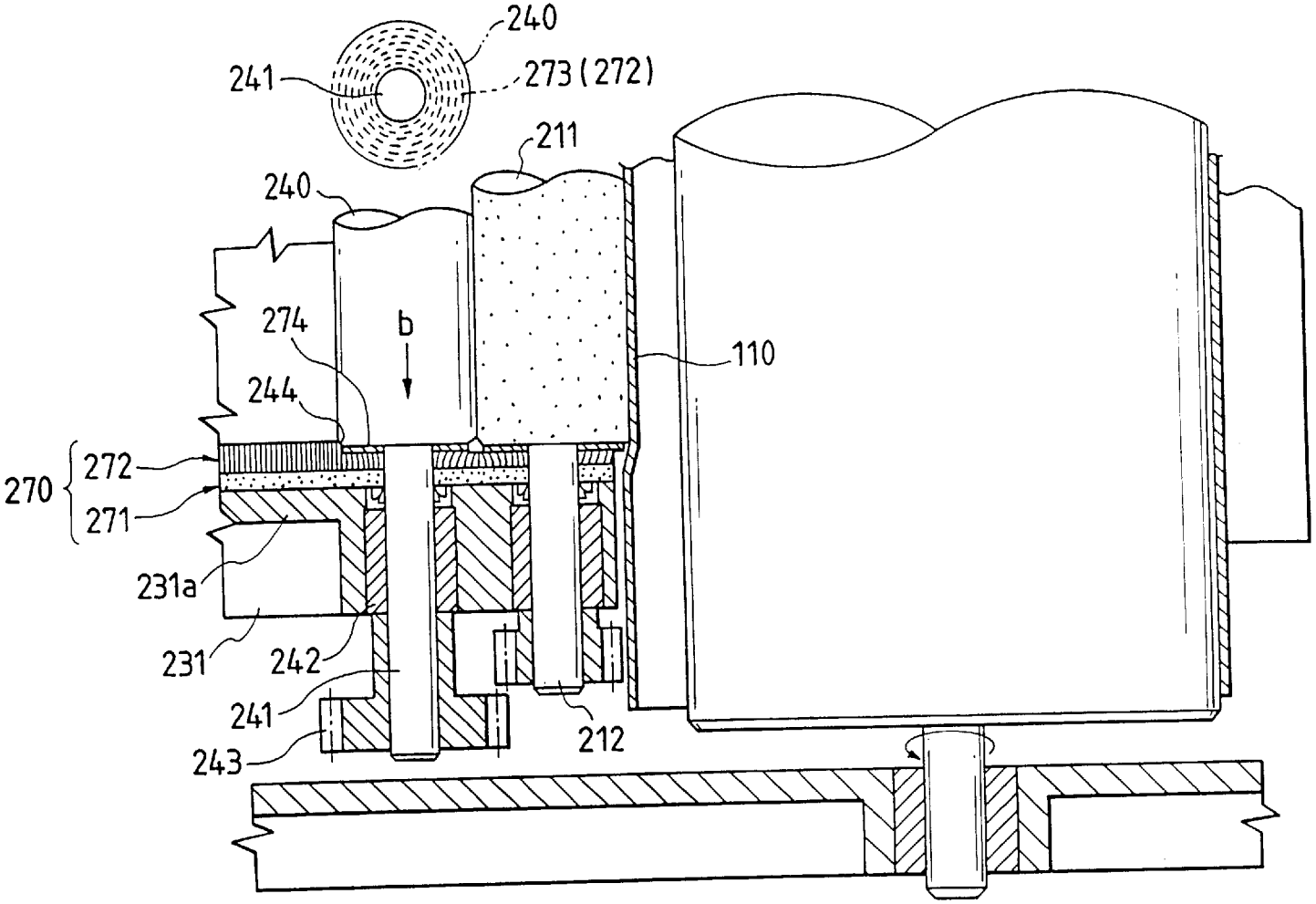
FIG. 5(*a*) is a partially-cut and enlarged cross sectional view taken along line V—V shown in FIG. 3, and FIG. 5(*b*) is a view taken in the direction of arrow b shown n FIG. 5(*a*).

The shaft 212 of the developing roller 211 is rotatably supported by the side walls 231*a* of the case body 231 in such a manner that at least an end of the shaft 212 penetrates the side walls 231*a*. Therefore, a sealing member 270 for preventing leakage of toner is provided. As shown in FIG. 5(*a*), the sealing member 270 is formed into a laminate obtained by sticking a foam member 271 in the form of a sheet to a napped material 272. The foam member 271 mainly attains the sealing pressure, while the napped material 272 mainly attains a sealing characteristic.

Because the length of the restraining blade is longer than the length of the surface of the developing roller for conveying toner, toner on the overall surface of the developing roller for conveying toner is uniformly restrained by the restraining blade. Therefore, any defect of the toner seal which is caused from toner excessively conveyed from the surface of the developing roller, or free toner which appears attributable to toner conveyed excessively, is prevented. Moreover, toner is uniformly formed over the surface of the developing roller and therefore serves as a lubricant between the photosensitive member and the developing roller. As a result, damage of the photosensitive member is reduced. Since the developing unit according to the present invention has the seals disposed at the ends of the developing roller, introduction of toner from the surface of the developing roller into the side end of the developing roller is prevented. Therefore, the sealing portion of the developing roller does not damage the photosensitive member as has been experienced with the conventional structure and excellent sealing of toner is achieved.

To further efficiently seal toner, the developing unit of the present invention is formed such that the quantity of elastic deformation of the sealing member is larger than the difference between the length of the restraining blade and the length of the surface of the developing roller for conveying toner. Specifically, the quantity of elastic deformation of the napped material 272 of the sealing member 270 is made larger than the difference between the length of the surface of the developing roller 211 and the length of the restraining blade. In this embodiment, the length of the fur of the napped material 272 is made to be 2 mm because the foregoing difference is 0.2 mm. Thus, the length satisfies the foregoing quantity of elastic deformation. The sealing member 270 arranged as described above is disposed at an end of the developing roller. Therefore, the sealing member flexibly follows a stepped portion generated by the difference in the length between the developing roller and the restraining blade thereby preventing leakage of toner from the stepped portion and thus the characteristic for sealing toner is further improved.

As shown in FIG. 5(*a*), the developing roller 211 is structured in such a manner that the end portions of the developing roller are chamfered so as to be rounded. The radius is made to be 0.2 mm. To further efficiently seal toner, the quantity of elastic displacement of the sealing member is larger than the quantity of chamfering of the developing roller 211. Specifically, the quantity of elastic displacement of furs of the napped material 272 of the sealing member 270 is made to be larger than the quantity of chamfering of the end portion of the developing roller 211. Since the radius of chamfering is 0.2 mm in this embodiment, the length of the furs of the napped material 272 is 2 mm which is included in the quantity of elastic displacement.

Because the end portion of the surface of the developing roller for conveying toner is chamfered, the end portion of the developing roller is not brought into contact with the photosensitive member. Thus, damage of the photosensitive member which occurs due to contact and sliding of the edge of the end portion of the developing roller is prevented. Since the quantity of the elastic displacement of the sealing member is larger than the quantity of chamfering of the end portion of the developing roller, the sealing member is able to flexibly follow the chamfered portion at the end of the developing roller. Therefore, the photosensitive member is not damaged by the end of the developing roller as has been experienced with the conventional structure.

Since the developing unit according to this embodiment has a sealed end portion of the developing roller, introduction of toner from the surface of the developing roller for conveying toner into the side end portion of the same is prevented.

Thus, leakage from the foregoing portion can be prevented and the characteristic for sealing toner is further improved.

The supply roller will now be described. As shown in FIG. 5(*a*), the supply roller 240 has a shaft 241 rotatably supported by side walls 231*a* of the case body 231 through the bearings 242 (one bearing is shown in FIG. 5(*a*)). A gear 243 for rotating the supply roller 240 is secured to an end of the shaft 241. A transmission gear (not shown) for transmitting the force supplied from a torque source (not shown) is engaged to the gear 243.

The restraining blade 260 is secured to a leading end 261*a* of a support plate 261. The support plate 261 has a bent rear end 261*b* supported by three hook portions 262*b* (see FIG. 4) of a base plate 262 secured to the case body 231. Thus, the support plate 261 is able to swing relative to the support portion. The support plate 261 is urged in such a manner that the support plate 261 presses the developing roller 211 through the restraining blade 260 by at least two (three in the structure shown in the drawing) tension springs 263 disposed between an intermediate portion 261*c* of the support plate 261 and a front portion 262*a* of the base plate 262.

The conveying fins 251, 252 and 253 (see FIG. 3) basically have the same structure as one another and have, similar to the above-mentioned supply roller 240, a shaft 254 rotatably supported by the side walls 231*a* of the case body 231. Moreover, each fin has an arm 255 secured to the shaft 254 and a fin 256 secured to the leading end of the arm 255 and formed into a thin plate (a sheet plate) having flexibility. Moreover, the fin has a gear or a ratchet secured to the shaft 254 at a position outside the case body 231. Thus, the fins 251, 252 and 253 can be rotated in the direction indicated by the associated 1 arrow shown in FIG. 3 by a torque source (not shown). Note that the number of revolutions of the conveying fins 251, 252 and 253 is determined to be about 1/20 to about 1/50 the numbering revolutions of the supply roller 240.

The case body 231 accommodates a toner reserving portion 233 formed into a cylindrical shape. When the fin 256 which is being rotated is slidably brought into contact with a wall surface 233*a* of the toner reserving portion 233, a wedge-shape space 233*b* is formed in which toner T is held and conveyed. That is, toner T is supplied through a route as conveying fin 253→252→251→supply roller 240, and then to the developing roller 211.

Since the conveying fins are structured in such a manner that the number of revolutions of the conveying fins is not less than 1/50 of number of revolution of the supply roller nor more than 1/20 of the same, excessive conveyance of toner to the supply roller portion by the conveying fins is further prevented.

If the number of revolutions of the conveying fins is larger than 1/20 the number of revolutions of the supply roller, toner conveyed by the conveying fins exceeds that which is consumed by the developing roller and the supply roller. Thus, toner is brought to a compressed state. In the compressed state, toner is moved before the excess portion of conveyed toner is returned to the conveying fins. Thus, the state of compression becomes more critical.

If the number of revolutions of the conveying fins is smaller than 1/50, the number of revolutions of the supply roller, the quantity of toner which is conveyed by the conveying fins is insufficient to compensate the quantity of toner which is consumed from the developing roller and the supply roller.

The developing unit of the present invention is able to prevent the compression of toner caused by the conveying member and also prevent the defects in conveyance experienced with the conventional structure.

To further prevent the compression of toner caused by the conveying member, the present invention includes a plurality of conveying fins disposed in a horizontal direction and the number of revolutions of the conveying fin nearest the supply roller is larger than the number of revolutions of each of the other conveying fins. Specifically, the rotations of the conveying fins 252 and 253 are slower than the rotation of the conveying fin 251 to prevent excessive conveyance of toner in a short time. Note that the number of revolutions of the conveying fin 251 is not less than 1/50 nor more than 1/20 of the number of revolution of the supply roller.

Since the structure of the present invention conveys toner in the case to the supply roller portion more slowly as described above, compression of toner in the supply roller portion is prevented. Because the conveying fin nearest the supply roller undergoes the above-mentioned number of revolutions, insufficient conveyance of toner is prevented, and also compression of toner caused by the conveying fins is prevented.

The conveying fins 251, 252, and 253 have different phases of rotation from one another so that the rotational loads are uniformed.

In a specific case in which n toner conveying devices are disposed together (n=3 in this embodiment), the angles among the conveying fins of the n conveying devices are shifted by 360°/n. Thus, the lengths for which the fin 256 is slidably brought into contact with the wall surface 233*a* is made to be substantially constant regardless of the angles of the conveying fins 251, 252 and 253. As a result, change in the load occurring before and after toner is elastically discharged by the conveying fins is dispersed. Even if dense toner having poor fluidity is used, the load of the conveying fins can be made uniform thereby preventing change in the torque required by the apparatus.

As described above (see FIGS. 1 and 2), the foregoing developing unit 210 represents four developing units 210Y for yellow images, 210C for cyan images, 210M for magenta images and 210K for black images, which are detachably attached to the frame 220.

Figure 6:
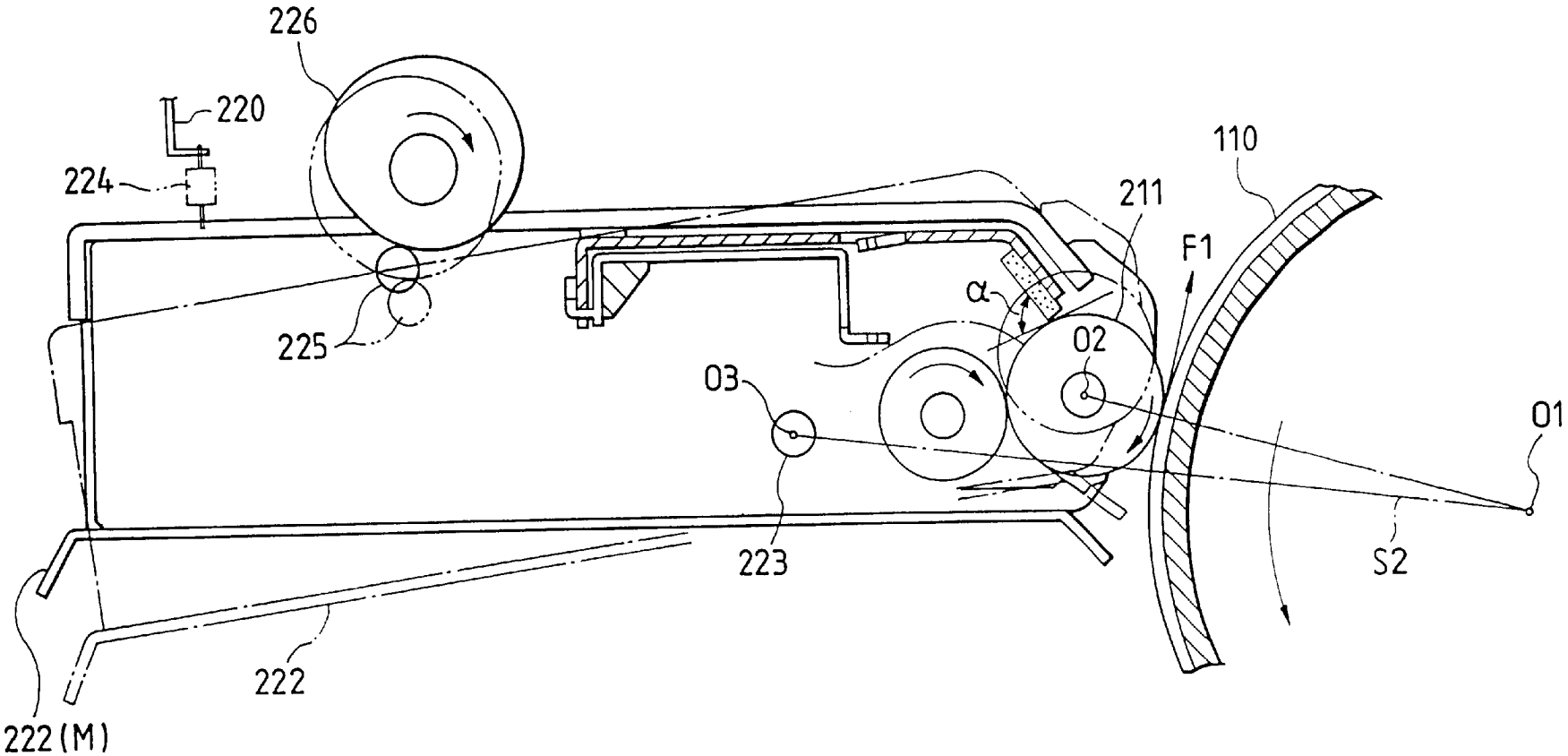
FIG. 6 is a diagram showing the operation of an exemplary developing unit.

Referring to FIG. 2, reference numeral 222 (Y, C, M and K) represents a receiving plate of each of the developing units 210 (Y, C, M and K). The receiving plate 222 has a pair of side plates (not shown) formed integrally therewith. As shown in FIG. 6, the receiving plate 222 is slidably joined to the frame 220 by a shaft 223 projecting over the outer surface of the side plate. A tension spring 224 is disposed between the side plate and the frame 220. The tension spring 224 urges the receiving plate 222 in a clockwise direction when viewed in FIG. 6, that is, in a direction in which the receiving plate 222 presses the developing roller 211 of the developing unit 210 against the photosensitive member 110.

At least one of the side plates is provided with a pin 225 for a cam in such a manner that the pin 225 for the cam is in contact with a cam 226 provided to the frame 220. As a result, the swinging operation of the side plate is restrained. The cam 226 is rotated by a drive device (not shown). When the cam 226 is placed at a position indicated with a solid line shown in FIG. 6, the developing roller 211 is pressed against the photosensitive member 110 due to the urging force of the tension spring 224. When the cam 226 is placed at a position indicated by the dashed line shown in FIG. 6, the cam 226 swings the receiving plate 222 and the developing unit 210 counterclockwise in such a manner that the developing roller 211 is separated from the photosensitive member 110.

The above-mentioned cam structure is provided for all of the receiving plates 222 (Y, C, M and K). Therefore, control of the rotation of the cam enables only any one of the developing rollers 211 to be brought into contact with the photosensitive member 110. The shaft 223 and pin 225 for the cam may be provided for the case body 231 of the developing unit 210.

Referring to FIG. 2, reference numeral 180 represents a sub-frame of the photosensitive unit 100. The sub-frame 180 accommodates the charging roller 120 and the cleaning device 130. The cleaning device 130 has a fur brush 131 for wiping toner left on the outer surface of the photosensitive member 110 off and a cleaner blade 132 for furthermore scraping toner left and allowed to adhere to the outer surface of the photosensitive member 110 off. Moreover, the cleaning device 130 has a toner conveying screw 133 serving as a conveying device for conveying toner wiped or scraped off by the fur brush 131 or the cleaner blade 132. A toner recovery chamber 182 is formed in the lower portion of the sub-frame 180. The toner recovery chamber 182 accommodates the fur brush 131, the cleaner blade 132 and the toner conveying screw 133.

The fur brush 131 is secured to a shaft 131*a*which penetrates the side plate of the sub-frame 180. When the shaft 131*a* is rotated by a drive device (not shown), the fur brush 131 is rotated in a direction indicated by the associated arrow shown in FIG. 2.

The cleaner blade 132 is joined to the sub-frame 180 by dint of a joint plate 132*a*. The leading end (the lower end) of the cleaner blade 132 is brought into contact with the outer surface of the photosensitive member 110 in such a manner as to scrape toner off.

The toner conveying screw 133 is rotated in a direction indicated by the associated arrow shown in FIG. 2 by a drive device (not shown) to convey toner accommodated in the toner recovery chamber 182 to a waste toner box (not shown) as waste toner.

A variety of contrivances are employed or permitted to be employed in this embodiment as described hereinafter.

<Position of Developing Unit 210>

As described above, the center of rotation of the conveying fin is disposed lower than the center of rotation of the supply roller in order to efficiently create a space for accommodating toner. Thus, the thickness of the developing unit has been reduced. However, the foregoing developing unit having the conveying fin disposed lower than the supply roller encounters difficulty in that the convey fin scrapes toner up to the surface of the toner supply roller even if the quantity of toner in the case has become insufficient. Such a defect in conveyance of toner undesirably causes the density of a formed image to deteriorate.

As shown in FIG. 2, an assumption is made that an angle made between a line S connecting the center of rotation of the supply roller 240 to the center of rotation of the developing roller 211 to the center of rotation of the conveying fin 251 and a horizontal line H is θ. All of the developing units 210 (which are four units for Y, C, M and K images in this embodiment) disposed around the photosensitive member 110 are disposed in such a manner that the following relationship in terms of θ is satisfied:

$$-20° < \theta < 75°$$

Note that angle θ is measured to have positive values in the clockwise direction from the horizontal line H.

If the angle θ is not more than −20°, toner cannot smoothly be conveyed from the conveying fin 251 to the supply roller 240. If the angle θ is 75° or larger, excess toner is conveyed to the supply roller 240 which leads to excessively compressed toner. The state of excessive compression is a phenomenon that the space formed by the developing roller 211, the supply roller 240 and the restraining blade 260 is filled with toner and thus the pressure in the space is raised excessively. If the excessive compression state is realized, toner on the developing roller cannot be limited to an appropriate quantity by the restraining blade, and toner overflows the restraining portion.

If the angle θ satisfies the above-mentioned range, toner is appropriately supplied to the supply roller 240 and is also appropriately supplied to the developing roller 211. Therefore, the plural developing units 210 can be disposed around the single photosensitive member 110. As a result, images can quickly be formed in such a manner that idle time can be shortened. Note that the diameter of the photosensitive-member 110 is determined to be in a range from 80 mm to 90 mm. And it is preferable that the range of θ satisfies $-12° < \theta < 56°$.

<Contrivances of Conveying fins 251, 252 and 253>

Toner in the case body 231 is conveyed in such a manner that toner is held in the wedge-shape space 233*b* formed when the rotating fin 256 is slidably brought into contact with the wall surface 233*a* of the toner reserving portion 233. Since the fin 256 has a thin flexible plate-like shape (the sheet-like shape) the fin is rapidly displaced and released at a portion near the supply roller. Specifically, when the fin 256 is separated from the wall surface 233*a* of the toner reserving portion 233, toner held in the wedge-shape space 233*b* and conveyed as described above is elastically discharged by dint of the restoring force generated by the elasticity of the fin 256. To achieve this elastic discharge, the quantity of displacement between the fin 256 and the wall surface. 233*a* is made large. The discharging force depends upon the rigidity (the elasticity) of the fin 256.

Therefore, (1) The rigidity of the fin 256 of the conveying fins 251, 252 and 253 is determined to be as follows:

The developing unit 210 (for example, the developing unit 210K) is disposed in such a manner that the angle θ has a small value so as to relatively enlarge the rigidity (the restoring force generated attributable to the elasticity) of the fin 256. On the other hand, the developing unit 210 (for example, the developing unit 210Y) is disposed in such a manner that the angle θ has a large value so as to relatively weaken the rigidity (the restoring force generated attributable to the elasticity) of the fin 256. As a result of the above-mentioned structure, an appropriate quantity of toner can be conveyed. In particular, it is preferable that the fin 256 of the conveying fin 251 for conveying toner to the supply roller 240 has the above-mentioned structure.

(2) The conveying fins 251, 252 and 253 are structured in such a manner that their rotational phases are varied to make uniform the loads which are generated during their rotations.

In a specific case in which n toner conveying devices are disposed together (n=3 in this embodiment), the angles among the conveying fins of the n conveying devices are shifted by 3.60°/n. Thus, the lengths of sliding for which the fin 256 is slidably brought into contact with the wall surface 233*a* is made to be substantially constant regardless of the angles of the conveying fins 251, 252 and 253. As a result, the rotational loads can be made uniform.

(3) As for a portion in which the fin 256 starts sliding on the wall surface 233*a*, the shape of the wall surface 233*a* is formed in such a manner that the deflection of the fin 256 is gradually enlarged. Thus, the rotational torque is reduced.

(4) As for a portion in which the fin 256 is separated from the wall surface 233*a*, the shape of the wall surface 233*a* is formed in such a manner that the deflection of the fin 256 is gradually suspended. Thus, the quantity (the force for discharging toner and/or the quantity of toner which must be discharged) of toner which must be conveyed is reduced. As a result, excessive conveyance of toner in the developing unit 210 (for example, the developing unit 210Y) in which toner is scraped downwards and conveyed is prevented which thereby prevents the excessive compression of toner.

To further efficiently convey toner, when the angle θ made between the line formed by connecting the center of rotation of the supply roller to the center of rotation of the conveying fin and the horizontal line, is in a range from −20 degrees to 0 degrees, an apparent density (A.D) of toner is made to be not less than 0.3 g/cc nor more than 0.5 g/cc.

If the conveyance characteristic is improved too much then excess toner is supplied to the supply roller 240 and the developing roller 211. As a result, toner on the developing roller 211 cannot be restrained causing toner to overflow to the outside portion of the developing unit 210. If the conveyance characteristic is unsatisfactory, the quantity of toner supplied to the supply roller 240 and the developing roller 211 becomes insufficient. As a result, a required image cannot be formed.

The conveyance characteristic depends on the fluidity of toner. In this embodiment, the quantity of the additive having the small diameter which affects the fluidity of toner was employed as a parameter for use in experiments. As a result, A.D is made to be 0.3 g/cc when the quantity of the additive is 1.0% or larger which gives a satisfactory conveyance characteristic. If the quantity exceeds 3.0%, the A.D undesirably exceeds 0.5 g/cc which leads to an excessive conveyance characteristic that causes toner to be leaked due to compression thereof. Therefore, it is preferable that the A.D of toner is not less than 0.30 g/cc nor more than 0.5 g/cc.

<Structure for Supporting Developing Roller 211 and Developing Unit 210 During Their Swinging Operations>

The developing roller 211 is made of SUS or AL having a diameter of 15 mm to 25 mm (more preferably about 18 mm). The surface of the developing roller 211 is subjected to a blasting process or a chemical polishing process to have appropriate roughness for holding toner.

As shown in FIG. 6, the developing roller 211 is arranged to rotate in synchronization with the photosensitive member 110. The circumferential speed of the developing roller 211 is made to be 1.5 times to 2.5 times (more preferably about two times) that of the photosensitive member 110.

As a result, a force F1 generated due to the reaction acts on the developing unit 210. To prevent the force F1 from acting in the direction of undesirable engagement, the structure is arranged in such a manner that the rotation center O2 of the developing roller 211 is located more adjacent to the direction in which the force F1 acts than line S2 which connects swing center O3 (the portion including the shaft 223) of the developing unit 210 and rotation center O1 of the photosensitive member 110 to each other. Moreover, the developing roller 211 is arranged to be moved in the direction in which the force F1 acts on the developing unit 210.

<Contrivance of Supply Roller 240>

(1) The supply roller 240 is preferably made of a porous and elastic material (for example, an expanded material, such as urethane) to hold toner on the surface thereof so as to supply toner to the developing roller 211 when the supply roller 240 rubs the developing roller 211.

It is preferable that the supply roller 240 is half embedded in toner (the upper half portion is exposed over the surface of toner) to supply toner to the developing roller 211.

When the circumferential speed of the supply roller 240 is made to be about 50% to 80% (more preferably about 60% to about 70%) of that of the developing roller 211, satisfactory supply of toner to the developing roller 211 is achieved. Moreover, deterioration in toner can be prevented.

(2) As described above, the shaft 212 of the developing roller 211, the shaft 241 of the supply roller 240 and each shaft 254 of the conveying fins 251, 252 and 253 are rotatably supported by the side walls 231*a* of the case body 231. At least the end of each axis penetrates the side walls 231*a*. Therefore, a sealing member must be provided for the penetrating portion to prevent leakage of toner.

Since the supply roller 240 is made of the porous and elastic material, the portion 240*a* of the supply roller 240 in which the supply roller 240 is in contact with the developing roller 211 is dented, as shown in FIG. 3. The foregoing state is schematically shown in FIGS. 7(*a*) and 7(*b*).

Figure 7A:
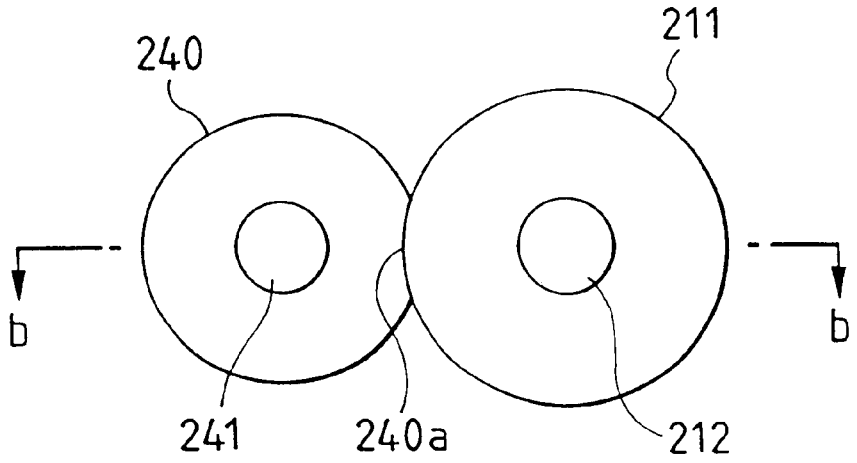
FIGS. 7(*a*) and (*b*) show the sealing effects.
Figure 7B:
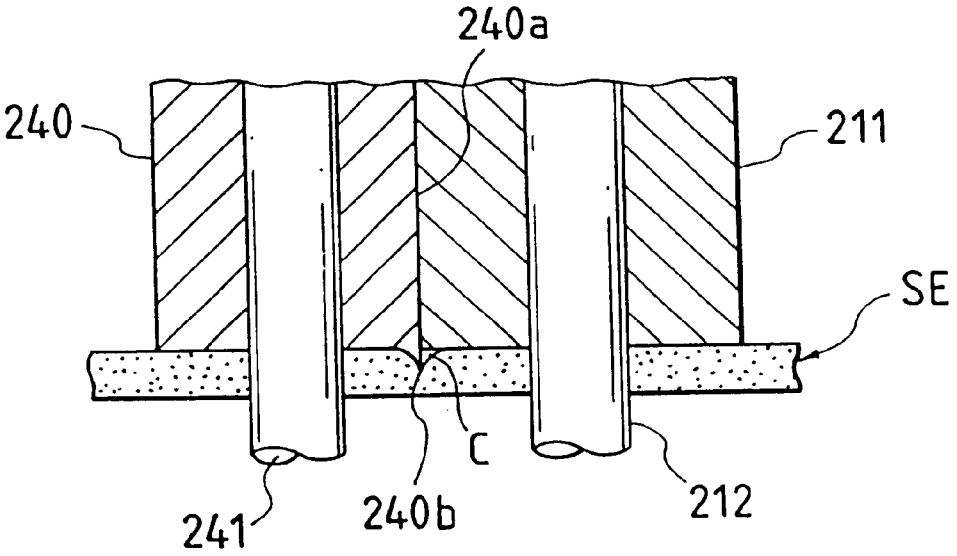

As can be understood from the drawings, a portion of the supply roller 240 which is dented by the contact portion 240*a*, projects sideways, as shown in FIG. 7(*b*). The projection is given reference numeral 240*b*. If the projection 240*b* engages the sealing member SE, the torque required to rotate the supply roller 240 is enlarged unsatisfactorily. Therefore, this embodiment has a chamfered corner portion 244 of the supply roller 240, as shown in FIG. 5(*a*). Note that chamfering may be formed by a straight line as shown in FIG. 5(*a*) or may be rounded. As a result of the structure of the present invention, the above-mentioned undesirable engagement is prevented, thus, torque required to rotate the supply roller 240 is reduced.

If engagement of the foregoing type takes place, a gap C is formed in the engaged portion at a position between the sealing member SE and the end surface of the developing roller 211, as shown in FIG. 7(*b*), which leads to toner being introduced into the gap C. If toner is introduced into gap C, then the sealing characteristic deteriorates and the end portion of the developing roller 211 is contaminated by toner. However, the structure of the present invention is able to prevent the above-mentioned problems.

<Contrivance of Sealing Member>

As described above, the shaft 212 of the developing roller 211, the shaft 241 of the supply roller 240 and each shaft 254 of the conveying fins 251, 252 and 253 are rotatably supported by the side walls 231*a* of the case body 231. At least the end of each axis penetrates the side walls 231*a*. Therefore, a sealing member is provided for the penetrating portion to prevent leakage of toner.

As shown in FIG. 5(*a*), this embodiment has a structure that a sealing member 270 is formed into a laminate obtained by sticking a foam member 271 in the form of a sheet and a napped material 272. The foam member 271 mainly attains the sealing pressure, while the napped material 272 mainly attains a sealing characteristic.

FIG. 5(*b*) is a view along arrow b of FIG. 5(*a*) which schematically shows a state of the napped material 272 disposed between an end of the roller (an end of the supply roller 240 in this case) and the foam member 271.

As can be understood from the foregoing drawings, the napped material 272 has napped members 273 which are formed into a discontinuous swirl shape attributable to rotations of the roller. That is, a so-called labyrinth seal is formed. Therefore, leakage of toner is reliably prevented. Moreover, the napped members 273 are formed into shapes following the rotation of the roller which reduces torque required to rotate the roller. Note that a sealing member 270 is provided for each of the shafts of the conveying fins 251, 252 and 253 though it is omitted from illustration in FIG. 5(*a*). Referring to FIG. 5(*a*), reference numeral 274 represents a sheet-shape lubricating material made of a fluorine material having low friction.

<Contrivance of Structure for Rotating Developing Roller 211>

As shown in FIG. 4, the shaft 212 of the developing roller 211 is supported by the side walls 231*a* of the case body 231 through the bearings 232. The transmission gear 214 for transmitting the rotating force is engaged to the gear 213 secured to an end of the shaft 212. Moreover, the rollers 215 are rotatably disposed at the two ends of the shaft 212. The rollers 215 are brought into contact with flanges (or portions outside image forming regions of the photosensitive member) formed at the two ends of the photosensitive member 110 when the developing roller 211 is pressed against the photosensitive member 110, as shown in FIG. 6. Thus, the position of the developing roller 211 with respect to the photosensitive member 110 is restrained.

When the developing roller 211 is pressed against the photosensitive member 110, horizontal loads act on the shaft 212 supported at the two ends of the shaft 212 by the rollers 215 through the case body 231 and the bearings 232. Thus, there is risk of the shaft 212 being deflected. If countermeasure is not taken, the deflection of the shaft 212 causes the state of engagement between the gear 213 and the transmission gear 214 to be instable. Therefore, as shown in FIG. 4, the present invention includes reference surfaces 213*a* and 214*a* for the gear 213 and the transmission gear 214, respectively, to stabilize the engagement between the gear 213 and the transmission gear 214.

<Other Contrivances>

(1) When the shapes and colors of the developing units 210 are varied, the positions of mounting can clearly be indicated.

(2) When the developing unit 210 is dismounted, the developing unit is arranged to pop up by a predetermined quantity in the direction of dismounting. Thus, the developing unit can easily be dismounted.

(3) The thickness of the developing unit 210 is reduced so as to easily be held by an operator with one hand which facilitates the mounting/dismounting operation.

Second Embodiment

Figure 8:
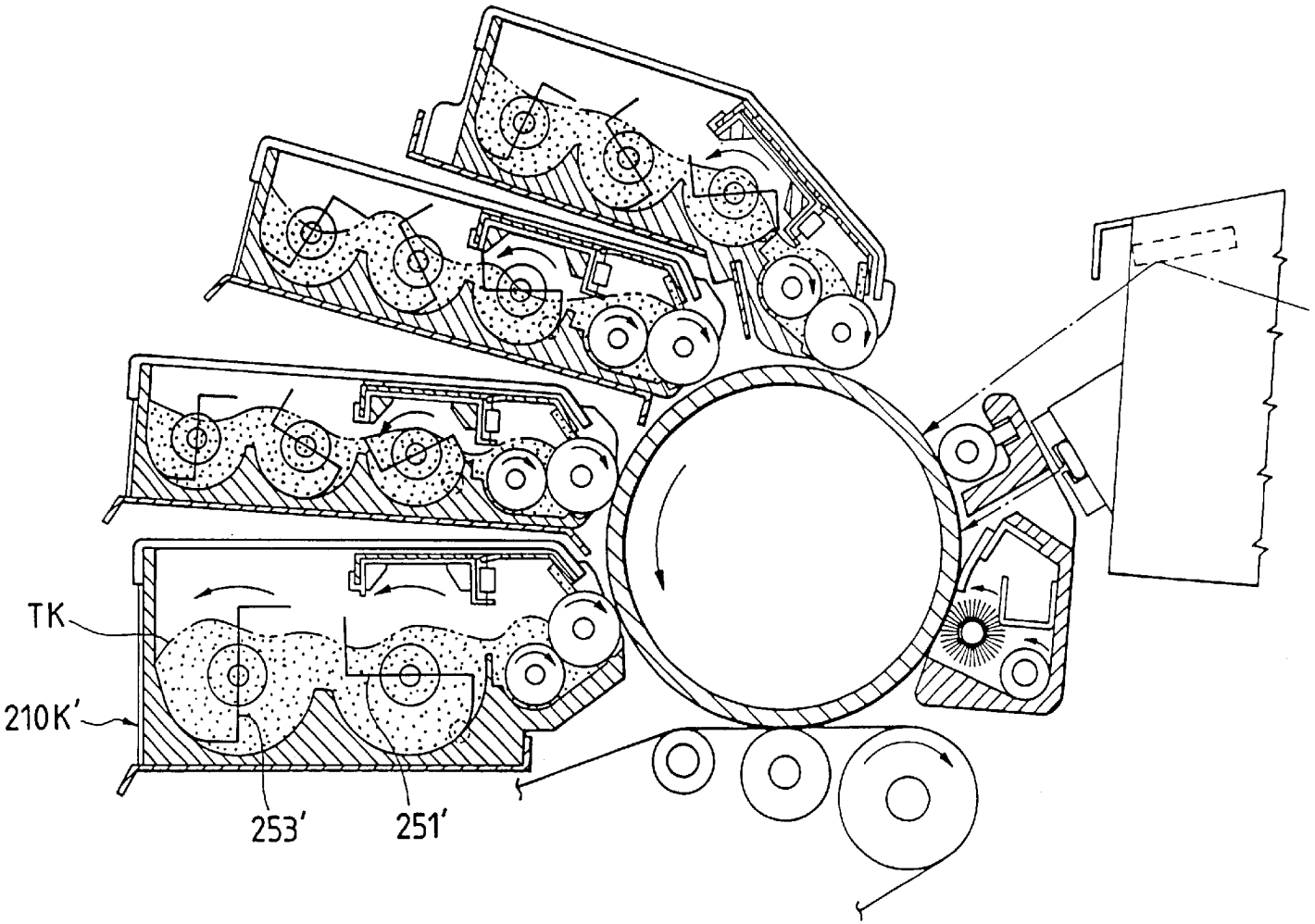
FIG. 8 is a schematic view showing an essential portion of an image forming apparatus having a developing unit according to a second embodiment of the present invention.

FIG. 8 is a schematic view showing an essential portion of an image forming apparatus employing a second embodiment of the developing unit according to the present invention.

In the second embodiment the (developing unit 210K' for black images) is different from the first embodiment. The other portions are the same. The developing unit 210K' for forming black images has somewhat large size to accommodate toner in a larger quantity. Moreover, two conveying fins 251' and 253' are provided. In general, the consumption of black toner is expected to be the largest among four colors of toner. Therefore, it is preferable that the developing unit 210K' has a large size as is employed in this embodiment.

Other Embodiments

More specific embodiments will now be described.

The following description is made about more specific structures of toner, the developing roller 211, the supply roller 240 and the restraining blade 260. To describe the effect of the specific structure or to cause the same to easily be understood, the developing characteristics realized by toner and the foregoing elements will be described. The developing characteristics are classified into a conveying characteristic, a supply characteristic, a filming phenomenon experienced with the developing roller, a filming phenomenon experienced with the restraining blade, a development efficiency, a sealing characteristic, fogging, durability, hysteresis phenomenon, irregularity of images and the difference in the density between the leading end and the trailing end. The influences of the above-mentioned structures on the characteristics and phenomena will be described. Moreover, the capacity of the hopper and the preservability considered to be important factors for the developing unit will be considered. Then, the arrangement of the structure will be described.

The basic structure of toner according to this embodiment is arranged in such a manner that pigment, CCA (Charge Control Agent) and wax are bound with synthetic resin. Moreover, an additive having a relatively large diameter for mainly realizing durability and another additive having a relatively small diameter for realizing fluidity are added to the surface realized by the binding process.

The developing characteristics will sequentially be described.

<Conveying Characteristic>

The conveying characteristic is a characteristic for conveying toner to the supply roller 240 by the conveying fin 251 and the like.

If the conveying characteristic is raised excessively, toner in an excessively large quantity is supplied to the supply roller 240 and the developing roller 211. As a result, toner on the developing roller 211 cannot be restrained, thus resulting in toner overflowing the developing unit 210.

If the conveying characteristic is unsatisfactory, the quantity of toner which must be supplied to the supply roller 240 and the developing roller 211 become insufficient. As a result, a required image cannot be formed.

The conveying characteristic considerably depends on the fluidity of toner. When the quantity of the additive having the small diameter and affecting the fluidity of toner is made to be 1.0% or larger, a satisfactory conveying characteristic can be obtained. If the quantity exceeds 3.0%, the conveying characteristic is raised excessively.

It is preferable that A.D of toner is not less than 0.30 g/cc nor more than 0.5 g/cc.

<Supply Characteristic>

The supply characteristic is a characteristic for conveying toner from the supply roller 240 to the developing roller 211. If the supply characteristic is unsatisfactory, image wanting takes place at the cycles of the supply roller 240. The supply characteristic is determined by the characteristic of toner and the structures of the supply roller 240 and the developing roller 211.

When the quantity of the additive having the small diameter is 1.0 wt % or larger, the characteristic for supplying toner is improved. When the quantity of the pigment is 15 wt % or smaller and that of the CCA is 3 wt % or smaller, the charging operation is able to satisfactorily start up and thus the supply characteristic can be improved.

When the depth of engagement (the depth of a dent of the supply roller 240) between the supply roller 240 and the developing roller 211 is 0.1 mm or larger, toner can sufficiently be rubbed on the developing roller 211. Thus, the frictional electrification is improved and the supply characteristic can be improved.

When the roughness of the surface of the developing roller 211 is 5 $\mu$m or greater in terms of Rz, the mechanical conveying force can be enlarged and thus a satisfactory supply characteristic is realized.

Although the supply characteristic can be improved by any one of the above-mentioned characteristics, combination of the characteristics will furthermore improve the supply characteristic.

If the supply characteristic is raised excessively, an excessive quantity of toner is supplied to the developing roller 211. Thus, the quantity of toner which must exist on the developing roller 211 cannot easily be controlled, and toner overflows the developing unit 210. If the quantity of the additive having the small diameter exceeds 3.0 wt %, excessive fluidity is realized. In this case, the supply characteristic is raised excessively.

It is preferable that the quantity of development (the quantity of toner developed on the photosensitive member 110) is 0.80 mg/cm$^2$ or smaller, that the quantity of conveyance (the quantity of toner on the developing roller 211 which is subjected to the development process) is 0.60 mg/cm$^2$ and the quantity of electrification is −8 $\mu$C/g or smaller.

<Filming Phenomenon Experienced with Developing Roller>

The filming phenomenon is one in which toner is melted and allowed to adhere to the surface of the developing roller 211. If the developing roller encounters the filming phenomenon, an image corresponding to the portion of filming occurrence is wanted or undesirable irregularity of thickness occurs.

In particular, the filming phenomenon of the developing roller depends on the supply characteristic of toner. If the toner supply characteristic is unsatisfactory, a portion is formed on the developing roller 211 in which the quantity of toner is too small. Thus, toner in the portion is stressed excessively by the restraining blade 260, and the developing roller 211, which causes the filming phenomenon to occur on the developing roller.

To improve the toner supply characteristic, the quantity of the CCA is made to be 3 wt % or smaller, the quantity of the pigment is 15 wt % or smaller and the quantity of the additive having the small diameter is made to be 1.5 wt % or greater. Although any one of the foregoing contrivances may be employed, combination of the contrivances will furthermore improve the supply characteristic.

<Filming Phenomenon Experienced With Restraining Blade>

This filming phenomenon is one in which toner is melted and allowed to adhere to the restraining blade 260. If the foregoing phenomenon occurs, images corresponding to the foregoing portion are wanted (white linear portions are formed).

The foregoing phenomenon is determined by the toner supply characteristic and a state of a portion in which the restraining blade 260 is brought into contact with the developing roller 211.

If the toner supply characteristic is unsatisfactory, a portion is formed on the developing roller 211 in which the quantity of toner is too small. Thus, toner in the portion is stressed excessively by the restraining blade 260, and the developing roller 211, which causes the filming phenomenon to occur on the restraining blade.

To improve the toner supply characteristic, the quantity of CCA is made to be 3 wt % or smaller, the quantity of the pigment is made to be 15 wt % or smaller and the quantity of the additive having the small diameter is made to be 1.5 wt % or smaller. Moreover, Tg (the glass transition point) is made to be 55° C. or higher and Tm (melting temperature) is made to be 110° C. or higher so that the abrasion resistance is improved to prevent the filming phenomenon.

Moreover, the restraining blade 260 is arranged in such a manner that the contact radius (the curvature radius (the radius of a circular arc portion) of a portion in which the restraining blade 260 is in contact with the developing roller 211) is made to be 100 $\mu$m or larger. Moreover, the angle of contact (angle $\alpha$) (see FIG. 6) formed between a line tangent to the developing roller 211 at a point where the restraining blade 260 is in contact with the developing roller 211 and the line along the restraining blade 260 is made to be 50° or greater. Thus, size of the space formed by the contact portion between the developing roller 211 and the restraining blade 260 can be set to a size which permits toner on the developing roller 211 restrained by the restraining blade 260 to be returned to the supply roller 240. If the size of the space is too small, toner excessively fills in this space which causes the filming phenomenon to occur.

Although any one of the foregoing contrivances may be employed, combination of the contrivances will furthermore improve the effect.

<Development Efficiency>

This efficiency is indicated by a ratio of a portion of toner actually used in the process for developing the photosensitive member 110 with respect to the overall quantity of toner brought to the developing position by the developing roller 211.

That is, the development efficiency is expressed as follows:

Developed Quantity/(Quantity of Conveyance×Circumferential Speed of Developing Roller)×100(%)

To improve the development efficiency, it is preferable that the quantity of the CCA be 0.5 wt % or greater, the quantity of development be 0.80 mg/cm$^2$ or smaller and the quantity of conveyance be 0.35 mg/cm$^2$.

<Sealing Characteristic>

The sealing characteristic is a manner of leakage of toner from toner seals (a seal for the lower surface is given reference numeral 275 in FIG. 3) provided for the end surfaces and the lower surface of the developing roller 211. Leakage of toner occurring in the image region causes a defective image. If leakage occurs on the outside of the image region, contamination of the inside portion of the apparatus takes place.

The fluidity of toner exerts an influence on the sealing characteristic. If toner has excessive fluidity, toner can easily be leaked through a gap between the developing roller 211 and the toner seal. Therefore, it is preferable that the quantity of the additive having the small diameter, which determines the fluidity of toner, be 3.0 wt % or smaller. It is preferable that the A.D is 0.40 g/cc or lower.

It is preferable that the surface roughness of the side surface (the end surface) of the developing roller be 0.5 $\mu$m or smaller in Rmax. If the surface roughness of the side surface of the developing roller exceeds 0.5 $\mu$m in Rmax, toner is undesirably held on the side surface of the developing roller. Then toner is conveyed when the developing roller is rotated, which causes leakage to the outside portion of the developing unit.

The toner seal 275 is allowed to abut against the developing roller. "Abutting against the developing roller" means a state except that in which the sealing member in the form of the film is allowed to abut against only the opened end which is not secured to the developing unit. That is, the foregoing state includes a state in which portions except for the end portion of the film are brought into contact with the developing roller and a state in which portions including the end portions ate brought into contact with the same. The sealing member is displaced because of the contact with the developing roller. It is preferable that the sealing member be brought into contact with the developing roller in such a manner that the quantity $\delta$ of displacement satisfies 0.1 mm<$\delta$<0.8 mm. It is preferable that the thickness t of the sealing member satisfies 50 $\mu$m<t<500 $\mu$m. The sealing member may be made of resin, such as polyethylene, polystyrene or polyester or rubber such as urethane rubber or silicon rubber, however the material is not limited to the foregoing material. As long as the film shape and elasticity can be obtained, any material may be employed.

<Fogging>

The fogging phenomenon is one in which toner adheres to a non-image portion (which is usually a white portion). If an inverse development process using negatively-charged toner is performed, the potential of the photosensitive member is about −50 V in the image portion and the same is about −600 V in the non-image portion. Moreover, the development bias is made to be about −300 V. Therefore, negatively-charged toner does not usually adhere to the non-image portion. If positively-charged toner exists on the developing roller, toner of this type undesirably adheres to the non-image portion. If toner having a small quantity of electrification exists, the force for attracting toner to the developing roller by electrostatic force and the like to constrain toner to the developing roller is unsatisfactory. Therefore, toner undesirably adheres to the photosensitive member.

The electrification polarities are made to be the same and the quantity of electrification of toner is enlarged (a small quantity in the case of negatively-charged toner) so that the fogging phenomenon is reduced. To enlarge the quantity of electrification of toner, the quantity of conveyance is reduced and the opportunity of contact between the electrification supply members (the restraining blade and the developing roller) and toner is increased to cause friction electrification to satisfactorily take place. It is preferable that the quantity of conveyance be 0.60 mg/cm$^2$ or smaller and the quantity of electrification be −8 $\mu$C/g or smaller. It is also preferable that the supply roller have the same potential as that of the developing roller.

<Durability>

The durability is a degree of deterioration in an image which takes place when images are superimposed. The deterioration in the image takes place due to deterioration of toner, filming of toner and wear of the restraining blade 260 or the like. The supply characteristic and transfer characteristic of toner deteriorate when the additive having the small diameter is embedded in the resin.

It is preferable that the quantity of the additive having the small diameter in toner is 1.5 wt % or greater and the quantity of the additive having the large diameter is 0.5 wt % or greater to prevent the additive having the small diameter from being embedded. The additive having the large diameter is silicon oil having a particle size of about 40 nm.

If the quantities of CCA and the pigment are too large, filming easily takes place and the durability deteriorates. Therefore, it is preferable that the quantity of CCA is 3 wt % or smaller and the quantity of the pigment is 15 wt % or smaller.

<Hysteresis Phenomenon>

This phenomenon is a phenomenon that a pattern of an image, which has been first formed, affects an image which is formed later. The hysteresis phenomenon occurs when start-up of the electrification of toner is unsatisfactory. The start-up of the electrification is determined by the quantities of the CCA and the additive in toner. If the quantity of the CCA is 0.5 wt % or larger, the start-up of the electrification is improved. If the coating ratio of the additive is low, the effect of the CCA can easily be obtained because the matrix particle containing the kneaded CCA can easily be brought into contact with the electrification supply member.

If the additive having the small diameter is added in a large quantity, the coating ratio is raised and the effect of the CCA cannot easily be obtained. If the additive having the large diameter is employed, the coating ratio is lowered as compared with the additive having the small diameter when the quantities of addition are the same with respect to the weight. Therefore, the effect of the CCA can easily be obtained.

If the quantity of the additive is too small, the supply characteristic deteriorates. Therefore, it is preferable that the quantity of the additive having the large diameter is not less than 1.5 wt % nor more than 5 wt % and the quantity of the additive having the small diameter is not less than 1.5 wt % nor more than 3 wt %. The additive having the large diameter is a material processed with silicon oil, while the additive having the small diameter is a material processed with HMDS (hexamethdisilanzane). It is preferable that the, particle size of the additive having the large diameter is about 40 nm and that of the additive having the small diameter is about 14 nm.

It is preferable that the difference in the quantity of electrification of toner between the leading end and the trailing end (to be described later) is 15 $\mu$c/g or smaller.

<Irregularity of Images>

This phenomenon is one in which images are formed irregularly in a case where regular images are attempted to be formed. The occurrence of this phenomenon depends upon the rotation cycles of the rotating members, i.e., the developing roller and the supply roller. If excessive deflection of the rotating member occurs, image irregularity easily takes place. Therefore, it is preferable that the deflection occurring from the center of rotation of the developing roller be 30 $\mu$m or smaller and that occurring from the center of rotation of the supply roller be 150 $\mu$m or smaller.

If the roughness of the base of a pipe for forming the developing roller realized before the roughness of the surface is adjusted exceeds 1 $\mu$m in Rmax, the roughness of the surface cannot easily be uniformed by a following process. In this case, irregularity of formed images easily takes place. Therefore, it is preferable that roughness of the base of the foregoing pipe is 1 $\mu$m or smaller in Rmax. If the material of a shaft serving as the center of rotation of the developing roller is too weak, the quantity of deflection which occurs by external force when the developing roller is rotated is excessively enlarged. Therefore, it is preferable that the material of the shaft be iron.

<Difference in Density Between Leading End and Trailing End>

This phenomenon is one in which the density (the quantity of development) is different between the leading end of an image and the trailing end of the same when a solid-color image has been formed. This phenomenon occurs because the quantity of electrification and that of conveyance of toner on the developing roller are different between the portions corresponding to the leading end and the portions corresponding to the trailing end and, therefore, the quantity of development is different.

The foregoing phenomenon can be prevented by making the difference in the conveyance of toner between the leading end and the trailing end to be 0.15 mg/cm$^2$ or smaller and by making the difference in the quantity of electrification 15 $\mu$C/g or smaller. Moreover, the phenomenon can be prevented by making the difference in the quantity of development 0.15 $\mu$g/cm$^2$ or smaller. To reduce the difference in the quantity of conveyance of toner where the linear speed of the developing roller is 300 mm/s or higher and the restricted load is 50 g/cm or lower, the restraining blade must be brought into contact with the surface at an edge thereof. If the restraining blade is brought into contact with a surface including surfaces in front of the ridge and in the rear of the same, the quantity of conveyance is enlarged excessively. To prevent the surface contact of the restraining blade, the angle of contact must not be less than 500 nor more than 850. It is preferable that the quantity of the CCA in toner is 0.5 wt % or greater.

<Capacity Hopper>

The hopper capacity is a capacity of toner in the case of the developing unit required to form images for a predetermined number of sheets. When toner having a high density (toner containing the pigment in a large quantity) is used, even toner in a small quantity is sufficient to realize a required density of an image. Therefore, employment of toner having a high density enables the hopper capacity to be reduced in such a manner that a required image density is maintained. Thus, the size of the developing unit 210 can be reduced. It is preferable that the quantity of the pigment is 5 wt % or larger.

<Preservability>

Preservability indicates a manner of deterioration of the above-mentioned characteristics in a state (of, for example, an environment of transportation or an environment of reservation) in which the apparatus is not operated. The deterioration of the foregoing type takes place due to the so-called a blocking phenomenon in which toner is solidified in the developing unit. When Tg of toner is made to be 55° C. or higher, the blocking phenomenon is prevented.

The developing characteristics are as described above. In consideration of the above-mentioned factors, the specific structures of toner, the developing roller 211, the supply roller 240 and the restraining blade 260 are determined as described hereinafter.

<Contrivance of Toner>

As described above, toner is prepared in such a manner that the pigment, the CCA (the Charge Control Agent) and the wax are bound with the synthetic resin. Moreover, the additive having the relatively large diameter for mainly realizing durability and the additive having the relatively small diameter for realizing fluidity are added to the surface realized by the binding process.

In this embodiment, the components and characteristics of the components were made as follows:

(1) Synthetic Resin

The synthetic resin was polyester to improve the fixing characteristic.

(2) Pigment

The quantity of the pigment was made to be not less than 5 wt % nor more than 15 wt %. so that the capacity of the hopper is reduced while the density of the formed image is maintained so as to reduce the size of the developing unit 210.

If the quantity of the pigment is 5 wt % or smaller, the saturation of a color image deteriorates. If the quantity exceeds 15 wt %, the supply characteristic deteriorates to the point where filming of the developing roller and filming of the blade easily take place.

(3) CCA

The quantity of the CCA was made to be not less than 0.5 wt % nor more than 3 wt %. The reason for this is as described above. If the quantity of the CCA exceeds 3 wt %, the transfer characteristic deteriorates.

(4) Wax

The quantity of the wax was 0.5 wt % or larger. The reason for this is that the separation characteristic of toner from the fixing roller must be improved. Moreover, such strengthens the fixing strength of toner to a recording medium, such as paper.

(5) Additive Having Relatively Large Diameter

The additive having the large diameter was silicon oil having a particle size of about 40 nm. The quantity of the additive was made not less than 0.5 wt % nor more than 5 wt %. The reason for this is as described above.

(6) Additive Having Relatively Small Diameter

The additive having the small diameter was HMDS having a particle size of about 14 nm. The quantity was not less than 1.0 wt % nor more than 3 wt %. The reason for this is that the fixing characteristic deteriorates if the quantity exceeds 3 wt %. It is preferable that the quantity is 1.5 wt % or larger to improve the transfer characteristic.

(7) Particle Size

The particle size of toner was not less than 6 $\mu$m nor more than 9 $\mu$m. The reason for this is that the cleaning characteristic deteriorates and the cost cannot be reduced if the particle size is 6 $\mu$m or smaller. If the particle size exceeds 9 $\mu$m, the resolution deteriorates.

Figure 9B:
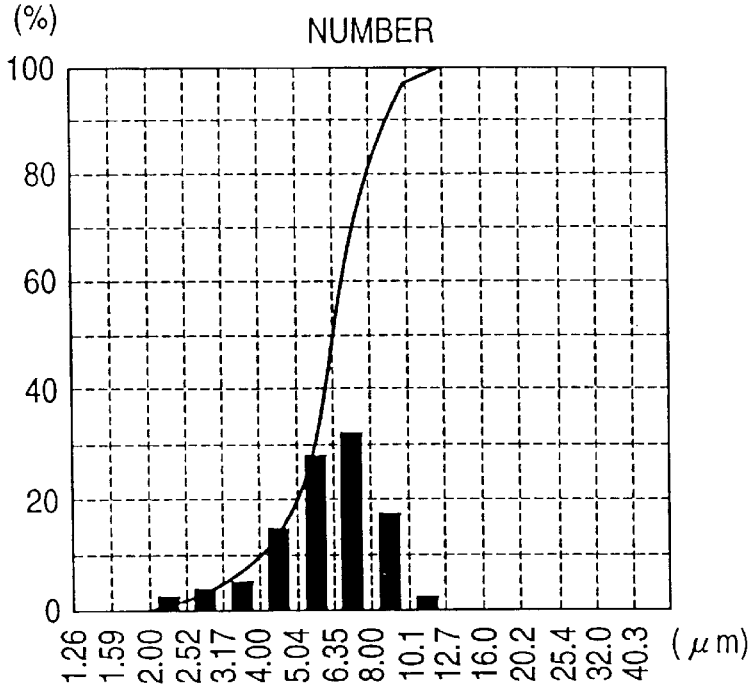
FIGS. 9(*a*), 9(*b*) and 9(*c*) show the distribution of the grain size of toner, in which FIG. 9(*a*) is a table showing the distribution of grain size and FIGS. 9(*b*) and 9(*c*) are graphs showing the distribution of the grain size.
Figure 9C:
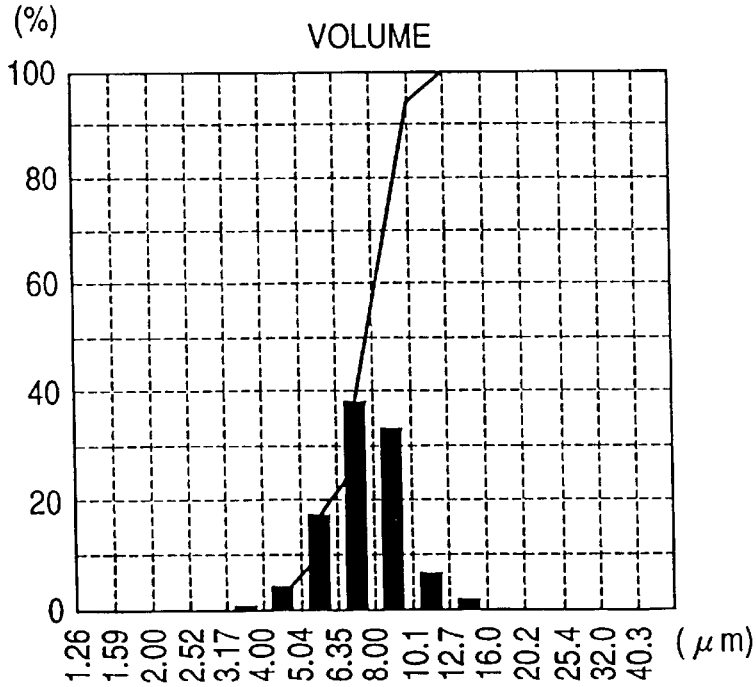

Distribution of particle sizes of toner employed in this embodiment is shown in FIGS. 9(*a*), 9(*b*) and 9(*c*). The distribution of the particle size of toner was measured using a coal tar counter model "TA-II". The aperture diameter was 100 $\mu$m and electrolyte was ISOTON-II.

In the table shown in FIG. 9(*a*), the number of samples is shown in the right-hand section, the volume is shown in the left-hand section, results measured are shown in the lower section and values obtained by calculations in accordance with the results of the measurement are shown in the upper section. Note that the "volume" is the volume realized when the measured toner particles are in the form of spheres. In the graphs shown in FIGS. 9(*b*) and 9(*c*), bar charts indicate data about the number and polygonal lines indicate cumulative data. The lower section in FIG. 9(*a*) indicating results of the measurement has the following meanings.

DIP N: most basic data which indicates data about the number (data about the number of toner) supplied through an I/O.

DIF %: which indicates data (DIF N) about the number for each channel.

CUM N: which indicates cumulative data (DIF N) about the number.

CUM %: which indicates cumulative DIF %.

The items in the upper section indicating values obtained by calculation have the following meanings. 25.4 $\mu\uparrow$: which indicates cumulative % exceeding 25.4 $\mu$m. 6.35 $\mu\downarrow$: which indicates cumulative % smaller than 6.35 $\mu$m.

KURTOSIS: which indicates the kurtosis (the sharpness) of the distribution.

SKEWNESS: which indicates the skewnesss of the distribution.

Average: which indicates an arithmetic average.

25%: particle size when the cumulative % reaches 25% (refer to graphs shown in FIGS. 9(*b*) and 9(*c*)).

50%: particle size when the cumulative % reaches 50% (refer to graphs shown in FIGS. 9(*b*) and 9(*c*)).

75%: particle size when the cumulative % reaches 75% (refer to graphs shown in FIGS. 9(*b*) and 9(*c*)).

CV%: coefficient of variation.

SD$\mu$: standard deviation ($\mu$m).

(8) A.D

The A.D was not less than 0.30 g/cc nor more than 0.40 g/cc. The reason for this is described above. If the foregoing range is satisfied, a satisfactory transfer characteristic is obtained. When the A.D is made to be 0.40 g/cc or lower, also the cleaning characteristic is improved.

(9) Coating Ratio of Additive

As for the coating ratio, a quantity with which 100%, that is, substantially the entire surface of the toner particle was covered with the additive (in terms of the projected area) was added.

(10) Tg

Tg was made to be 55° or higher. The reason for this is as described above.

(11) TM

Tm was made to be not lower than 110° C. nor higher than 130° C. The reason for this is as described above. If the toner is 130° C. or higher, the fixing characteristic deteriorates.

(12) Distribution of Molecular Weight

The distribution of molecular weight (MW/MN) was made to be 100 or greater. If the distribution is 100 or smaller, the fixing characteristic deteriorates.

(13) Quantity of Development

The quantity of development was not less than 0.40 mg/cm$^2$ nor more than 0.8 mg/cm$^2$. The difference between the leading end and the trailing end was 0.15 mg/cm$^2$. The reason for this is as described above. If the quantity is 0.40 mg/cm$^2$ or smaller, the density of the image is lowered. If the quantity is 0.80 mg/cm$^2$ or larger, the transfer characteristic to deteriorates.

(14) Quantity of Conveyance.

The quantity of conveyance was made not less than 0.35 mg/cm$^2$ nor more than 0.60 mg/cm$^2$. The difference between the leading end and the trailing end was made to be 0.15 mg/cm$^2$. The reason for this is as described above.

(15) The Quantity of Electrification

The quantity of electrification was made not less than −35 $\mu$C/g nor more than −8 $\mu$C/g. The reason why the quantity was made to be −8 $\mu$C/g or smaller is as described above. If the quantity is −35 $\mu$C/g, the transfer characteristic deteriorates.

(16) Shape of Toner

The shape factor of toner is defined in such a manner that, for example, "FE-SEM" (S-800) manufactured by Hitachi is used to randomly sample 100 toner images multiplied to 500 times. Image information of the sample images is analyzed by, for example, an image analyzer ("Luzex III") manufactured by Nicol, through an interface. Values obtained by the following equations are defined to be shape factors.

$$\text{Shape Factor (SF-1)}=(\text{MXLNG})^2/\text{AREA}\times\pi u/4\times 100$$

$$\text{Shape Factor (SF-2)}=(\text{PERI})^2/\text{AREA}\times 1/4\pi\times 100$$

where MXLNG is an absolute maximum length, PERI is the circumference of toner and AREA is a projected area.

The shape factor SF-1 indicates the degree of roundness of toner, while shape factor SF-2 indicates the degree of projections and depressions of toner. It is preferable that the shape factor SF-1 of toner is 100 to 150, more preferably 100 to 130. It is preferable that the shape factor SF-2 of toner is 100 to 140, more preferably 100 to 125. Since the shape factors SF-1 and SF-2 are determined as described above, the transfer efficiency in the primary and secondary transfer operations is improved.

In the embodiment of the present invention, the developing unit is structured so that the ratio of open cells of the supply roller is 30% or higher, the depth of engagement of the supply roller to the developing roller is 0.4 mm or smaller, the shape factor SF-1 of toner is 150 or smaller and the shape factor SF-2 is 140 or smaller. As a result of the above-mentioned structure, even if toner is introduced into the cells formed in the surface of the supply roller, the supply roller is made of the open-cell expanded material thus enabling cells to have sufficiently large capacities so as to prevent clogging of toner in a short time. Because the shape factor SF-1 of toner is 150 or smaller, that is, since toner has a spherical shape, a substantial volume of toner in the cell can be reduced even if the cells are enclosed with toner. As a result, clogging of the supply roller with toner in a short time is prevented. Therefore, an expanded material having a low ratio of open cells as compared with that of the conventional expanded material is employed. Since the shape factor SF-2 of toner is 140 or smaller, that is, since the surface projections and depressions are reduced and smoothed, toner introduced into the cells can easily be discharged from the cells even if the cells are filled with toner. Even if toner is coagulated in the cells attributable to pressure, toner can easily be crushed. Even if coagulated toner is discharged from the cells, the restraining blade is not clogged with the toner, because toner of the foregoing type can easily be crushed, therefore no defects take place in the formed images.

Accordingly, the hardness of the supply roller is not increased over time, as has been experienced with the conventional structure. Thus torque required to rotate the supply roller is reduced.

<Contrivance of Developing Roller>

(1) Material of the shaft was iron having a diameter of 5 mm.

(2) The surface roughness of the end surface of the flange (each end surface (side surface) of the developing roller) was 0.5 $\mu$m or lower in Rmax. The reason for this is to improve the sealing characteristic.

(3) The corner portion, i.e., between the cylinder surface and the end surface (the side surface), of the developing roller was rounded or chamfered, with the roundness being 0.1 mm or greater. The reason for this lies in that the photosensitive member. 110 must be protected from damage by the corner portion.

(4) The surface roughness was not lower than 5 $\mu$m in Rz nor higher than. 10 $\mu$m in Rz. If the roughness is lower than 5 $\mu$m in Rz, the toner supply characteristic deteriorates. If the roughness is 10 $\mu$m or greater in Rz, the resolution of the image deteriorates.

(5) The deflection was made to be 30 $\mu$m. The reason for this is as described above. If the deflection exceeds 30 $\mu$m, also the toner supply characteristic deteriorates.

(6) The tolerance of the outer diameter was about ±0.02 mm, so as to maintain the supply characteristic and to prevent irregularity of images.

<Contrivance of Supply Rollers>

(1) Material of the shaft was iron having a diameter of 5 mm so as to prevent irregularity of images.

(2) The deflection was 150 $\mu$m or smaller so as to prevent irregularity of images.

(3) The tolerance of the outer diameter was about ±0.15 mm so as to maintain the supply characteristic and to prevent irregularity of images.

(4) Hardness was not lower than 40° nor higher than 70°. If the hardness is 40° or lower, the supply characteristic deteriorates. If the hardness is 70° or higher, the required rotational torque is increased.

(5) A ratio of open cells was 30% to 80% so as to maintain the supply characteristic.

(6) The grinding direction (with respect to the direction in which the supply roller is rotated) was the forward direction so as to maintain the supply characteristic.

(7) The circumferential speed ratio with respect to the developing roller 211 was about 50% to about 80%, more preferably 60% to 70%, and specifically about 64%.

If the ratio is 50% or lower, the toner supply characteristic to the developing roller cannot be maintained. If the ratio is 80% or higher, toner deteriorates and also the drive torque is enlarged excessively.

(8) The depth of engagement (the quantity of dent in the portion of the supply roller that contacts with the developing roller) was not less than 0.1 mm nor more than 0.4 mm. If the depth is 0.1 mm or smaller, rubbing of toner to the developing roller becomes unsatisfactory. If the depth is 0.4 mm or greater, the drive torque is undesirably enlarged.

(9) The potential was the .same as that of the, developing roller so as to prevent fogging and hysteresis.

<Contrivance of Restraining Blade>

(1) The radius of contact with the developing roller 211 was not smaller than 30 μm nor larger than 150 μm, so as to attempt to maintain the required quantity of toner which must be conveyed. The reason the radius is made to be 150 μm or smaller, is because the difference in the density between the leading end and the trailing end must be as little as possible.

(2) The angle of contact with the developing roller 211 was not smaller than 50° nor larger than 85°.

The angle must be 50° or larger so that the difference in the density between the leading end and the trailing end is reduced. The angle must be 85° or smaller so that filming of the blade is prevented.

(3) The straightness was 30 μm or smaller so that irregularity of images (irregularity in the density over the image, and in particular in the widthwise direction of the image) is prevented.

(4) The surface roughness was 15 μm or smaller in Rz so that hair-line irregularity (thin image irregularity in the form of hair lines which wants images in parallel to the direction in which paper is conveyed)is prevented.

Although the invention has been described in its preferred form, it is understood that the present disclosure of the preferred form can be changed in detail of construction and in the combination and arrangement of parts without departing from the spirit and the scope of the invention as hereinafter claimed.

We claim:

1. A developing unit, comprising:

a case for accommodating toner which contains pigment by 5 wt % or more contained within said case;

a developing roller rotatably supported by said case through a shaft;

a supply roller rotatably supported by said case through a shaft and formed by an elastic member arranged to be pressed against said developing roller in such a manner as to supply toner to the surface of said developing roller; and at least two conveying fins each rotatably supported by said case through a shaft so as to convey toner to the surface of said supply roller wherein said developing roller, said supply roller and said conveying fins are sequentially disposed so that the phases of rotation of said at least two conveying fins are different from one another, such that loads generated by said at least two conveying fins during rotation are uniform.

* * * * *